US009708045B1

(12) United States Patent
Woody

(10) Patent No.: US 9,708,045 B1
(45) Date of Patent: Jul. 18, 2017

(54) WATERCRAFT ADJUSTABLE SHAFT SPACING APPARATUS AND RELATED METHOD OF OPERATION

(71) Applicant: Platinum Marine Inc., Pinconning, MI (US)

(72) Inventor: Clark M. Woody, Pinconning, MI (US)

(73) Assignee: Platinum Marine Inc., Pinconning, MI (US)

( * ) Notice: Subject to any disclaimer, the term of this patent is extended or adjusted under 35 U.S.C. 154(b) by 0 days.

(21) Appl. No.: 15/411,511

(22) Filed: Jan. 20, 2017

Related U.S. Application Data

(60) Provisional application No. 62/358,334, filed on Jul. 5, 2016.

(51) Int. Cl.

| | |
|---|---|
| ***B63H 5/125*** | (2006.01) |
| ***B63H 20/18*** | (2006.01) |
| ***B63H 21/14*** | (2006.01) |
| ***B63H 23/06*** | (2006.01) |

(52) U.S. Cl.
CPC ..... *B63H 20/18* (2013.01); *B63H 5/125* (2013.01); *B63H 21/14* (2013.01); *B63H 23/06* (2013.01); *B63B 2758/00* (2013.01); *B63H 2023/062* (2013.01)

(58) Field of Classification Search
CPC ..... B63H 20/18; B63H 5/125
USPC ..... 440/65, 61 E, 6
See application file for complete search history.

(56) References Cited

U.S. PATENT DOCUMENTS

| | | | | |
|---|---|---|---|---|
| 1,780,552 | A * | 11/1930 | Coggins et al. | B63H 20/106 440/65 |
| 4,244,454 | A | 1/1981 | Bankstahl | |
| 4,544,362 | A | 10/1985 | Arneson | |
| 4,565,532 | A | 1/1986 | Connor | |
| 4,645,463 | A | 2/1987 | Arneson | |
| 4,728,308 | A | 3/1988 | Weismann | |
| 4,764,032 | A | 8/1988 | Tanaka | |
| 4,775,342 | A | 10/1988 | Connor et al. | |
| 4,790,782 | A | 12/1988 | McCormick | |
| 5,326,294 | A | 7/1994 | Schoell | |
| 5,415,576 | A | 5/1995 | Meisenburg et al. | |
| 5,647,780 | A | 7/1997 | Hosoi | |
| 5,791,954 | A | 8/1998 | Johnson, Jr. | |
| 5,863,230 | A | 1/1999 | Morrison | |
| 5,934,955 | A | 8/1999 | Heston | |
| 5,964,627 | A | 10/1999 | Detwiler | |

(Continued)

*Primary Examiner* — Stephen Avila
(74) *Attorney, Agent, or Firm* — Warner Norcross and Judd, LLP

(57) ABSTRACT

An outdrive for a marine vessel, such as a watercraft having an inboard engine, is provided. The outdrive can include an upper drive unit having a driveshaft that rotates in response to rotation of an input shaft coupled to an engine within a hull of the watercraft. The upper drive unit is movably joined with a lower drive unit, which includes a propeller shaft that rotates in response to rotation of the driveshaft, and an associated propeller. The lower drive unit is movable from a raised mode, in which it is adjacent the upper drive unit, to a lowered mode, in which it is a preselected distance from the upper drive unit, thereby lowering a thrust point produced by the propeller, all while the watercraft is moving through water and while the propeller is producing thrust. A related method and outdrive upper unit are also provided.

15 Claims, 16 Drawing Sheets

(56) References Cited

U.S. PATENT DOCUMENTS

| | | | | |
|---|---|---|---|---|
| 6,383,043 | B1 | 5/2002 | Heston | |
| 6,431,927 | B1 | 8/2002 | Sage | |
| 6,468,119 | B1 * | 10/2002 | Hasl | B63H 5/125 440/57 |
| 6,523,655 | B1 | 2/2003 | Behara | |
| 6,960,107 | B1 | 11/2005 | Schaub et al. | |
| 7,163,427 | B1 * | 1/2007 | Lee | B63H 20/007 440/6 |
| 7,985,109 | B2 | 7/2011 | Mansfield et al. | |
| 2009/0117791 | A1 | 5/2009 | Huddleston | |

* cited by examiner

WATERCRAFT ADJUSTABLE SHAFT SPACING APPARATUS AND RELATED METHOD OF OPERATION

BACKGROUND OF THE INVENTION

The present invention relates to watercraft, and more particularly to a watercraft outdrive that can move a propeller and its shaft relative to a watercraft bottom while the watercraft is under power.

There is a variety of watercraft used in different activities. Some watercraft is used for commercial purposes, while others are used for recreation or competition. Many watercraft, or boats include an inboard motor. The engine of such boats is located inside the hull of the boat, and an outdrive projects rearward from the stern of the boat. The outdrive typically includes a transmission that transfers rotational forces from the engine to a propeller shaft and an associated propeller. Upon rotation, the propeller produces thrust to propel the boat through water.

Conventional outdrives of inboard watercraft are constructed so that the outdrive can tilt about a pivot point to tilt the propeller upward or tilt the propeller downward. Upon such tilting, however, the angle of the propeller and the associated thrust changes significantly. For example, when an outdrive is tilted upward, the tilted angle of the propeller makes maneuvering the boat more difficult because the thrust is projected upward toward the water surface instead of being projected rearward, behind the boat.

Even with such tilt features, an issue with conventional outdrives of inboard watercraft is that the vertical displacement of the propeller shaft and propeller is generally fixed and immovable relative to the bottom of the watercraft. With this fixed relationship relative to the bottom of the watercraft, conventional outdrives fail to effectively provide vertical adjustment of the propeller shaft and propeller. Thus, the thrust point of the drive is fixed and nonadjustable.

The fixed relationship of the propeller shaft relative to the bottom of the boat also presents challenges to boat builders. To mount a standard drive at the surface of water, the builder will mount the engine higher within the hull of the boat. This in turn raises the center of gravity of the boat. In some cases, this can make it unstable. Raising the center of gravity can impair the boat's handling characteristics. This can create issues, particularly when the boat turns at high speed.

With a given height of the engine above the bottom of the boat, boat builders also struggle to identify the ideal propeller shaft location relative to the bottom of the boat when setting it in that fixed, permanent position. Usually, the builder uses trial and error techniques to place the propeller shaft at a particular location. Some boat builders and consumers will attempt to change the location of the propeller shaft relative to the bottom of the boat. For example, a consumer might purchase an outdrive lower unit that differs from the OEM lower unit offered at a standard height. These outdrive lower units typically enable the user to adjust the propeller shaft location in one inch increments.

An issue with modifying the outdrive to replace one lower unit for another is that this modification must be done by removing the boat from the water and disassembling the outdrive and its components out of the water. This can be time-consuming and expensive. Users also can utilize spacer plates that are placed between upper and lower units of the outdrive. Again, however, the final set up of the spacer plate and/or different lower unit is fixed and cannot be changed without removing the boat from the water and disassembling the lower unit to add or subtract a spacer plate, or to replace the lower unit altogether with a different sized lower unit.

Another complicating factor in finding the ideal propeller shaft location is that the configuration and loading of the watercraft can change what that ideal propeller shaft location should be. For example, when a watercraft is loaded with gear and occupants on board, this can alter the ideal propeller shaft location. Full or empty fuel tanks also can change the location.

Further, with a fixed and immovable propeller shaft location, conventional outdrives can limit performance, particularly in race boats. Race boats typically run the propeller shaft at the surface of the water when the boat is under power to maximize speed. When the race boat turns around an obstacle, such as a buoy, at speed, less skeg of the outdrive is in the water. With less skeg in the water, the boat is more prone to skim the surface of the water and potentially spin out. In some cases, this can create dangerous situation for the racers as well as observers.

Surface drive boats with a fixed and immovable propeller shaft location also are difficult to maneuver around a dock or other obstacle where a reverse direction is helpful. For example, surface drive propellers, when in reverse, thrust water against the stern, and in particular the transom of the boat. This helps very little to propel the boat rearward because this thrust is wasted.

Accordingly, there remains room for improvement in the field of outdrives for watercraft with inboard motors.

SUMMARY OF THE INVENTION

An outdrive for a marine vessel, such as a watercraft, that can move a propeller and its shaft relative to a watercraft bottom while the vessel is under power is provided.

In one embodiment, the outdrive is joined with a watercraft having an inboard engine. The outdrive can include an upper drive unit having a driveshaft that rotates in response to rotation of an input shaft coupled to the inboard engine. The upper drive unit is movably joined with a lower drive unit, which includes a propeller shaft and an associated propeller that rotate in response to rotation of the driveshaft.

In another embodiment, the lower drive unit is movable from a raised mode, in which it is adjacent the upper drive unit, to a lowered mode, in which it is a preselected distance from the upper drive unit. This changes the location of the lower drive unit, thereby lowering a thrust point produced by the propeller, all while the watercraft is moving through water and while the propeller is producing thrust.

In a further embodiment, the lower drive unit moves so that in both the raised mode and the lowered mode, and movement therebetween, the propeller shaft is maintained at a fixed angle relative to a reference line projecting rearward from a bottom of a transom of the watercraft. In this manner, the propeller shaft is inhibited from and generally does not tilt longitudinally relative to the reference line. Instead, the propeller shaft simply moves vertically, upward and downward, while maintaining a fixed spatial orientation relative to the transom and a reference line.

In another embodiment, the outdrive can be equipped with a tilt assembly configured to tilt the outdrive up and down relative to the transom or hull of the watercraft. The tilt assembly can include a tilt actuator joined with the upper drive unit and/or lower drive unit. The tilt actuator can extend to tilt the upper unit and lower unit upward thereby changing the angle of the propeller shaft relative to the reference line. The tilt actuator can retract to tilt the upper unit and lower unit downward, thereby changing the angle of the propeller shaft relative to the reference line. This tilting action is different from the adjustment of the propeller shaft placement when the lower unit is moved from the raised mode to the lowered mode or vice versa. In the latter cases, the propeller shaft can be maintained at a fixed angle relative to the bottom of the watercraft and/or the reference line.

In even another embodiment, the outdrive can include a drive assembly. The drive assembly can include a driveshaft that rotates in response to rotation of the input shaft extending from the engine. The driveshaft can be rotatably coupled to the propeller shaft directly or indirectly. The drive assembly can include a ball spline through which the driveshaft and/or an associated connector shaft extends. The ball spline can be configured to allow the driveshaft and/or an associated connector shaft to move linearly through the ball spline and/or along a longitudinal axis of the ball spline. The ball spline however engages the driveshaft so that the ball spline and driveshaft do not rotate relative to one another. The driveshaft and ball spline rotate together in unison when the ball spline is rotated. The ball spline and driveshaft can be fixed and non-rotatable relative to one another.

In even another embodiment, the outdrive can include a drive assembly. The drive assembly can include a driveshaft that rotates in response to rotation of the input shaft extending from the engine. The driveshaft can be rotatably coupled to the propeller shaft directly or indirectly. The drive assembly can include a connector shaft and a driveshaft joined via a spline. The connector shaft can be joined with a driveshaft gear. The spline can be configured to allow the driveshaft to move linearly along a common axis of the connector shaft. Accordingly, the driveshaft can extend and retract linearly, along the common axis relative to the connector shaft. Due to the spline connection, the connector shaft and driveshaft also rotate in unison when the connector shaft and/or driveshaft gear is rotated. The connector shaft, spline and driveshaft can be fixed and non-rotatable relative to one another.

In yet another embodiment, the outdrive can include a guide assembly. The guide assembly can include one or more guide shafts that guide the lower drive unit along a uniform, generally linear path when the lower drive unit moves relative to the upper drive unit. The guide shafts can each respectively be movably disposed within one or more guide shaft bores defined by the upper drive unit and/or the lower drive unit. The guide shafts can be configured to telescope relative to the guide shaft bores upon movement of the driveshaft and/or a connector shaft relative to the reference line, and/or when the lower drive unit is moved from the lowered mode to the raised mode or vice versa.

In still another embodiment, the outdrive can include a vertical adjustment assembly that moves the lower drive unit relative to the upper drive unit. This vertical adjustment assembly can include a spacing actuator, such as a hydraulic cylinder, that is joined with the upper drive unit as well as the lower drive unit. The spacing actuator can extend and retract, and thereby move the lower drive unit away from and toward a bottom of the upper drive unit respectively. In turn, this alters the spacing between the propeller shaft and the reference line of the transom, or more generally the spacing of the propeller shaft relative to a bottom of the upper drive unit.

In still a further embodiment, the outdrive can include a driveshaft seal assembly. This driveshaft seal assembly can shield the driveshaft and any associated connector shaft from the environment around the outdrive, for example from surrounding water, particularly when the lower drive unit is lowered to the lowered position. The driveshaft seal assembly can include a shaft seal piston defining an internal shaft seal bore. The driveshaft can extend within the internal shaft seal bore. Optionally, the shaft seal piston is movably joined with the upper drive unit so that the shaft seal piston lowers from the upper drive unit to cover the driveshaft, even when the lower drive unit is in the lowered mode. The shaft seal piston surrounds the driveshaft, even when the driveshaft is rotating, to shield the driveshaft from water within which the outdrive is operated, and/or to prevent oil on the driveshaft from contaminating the surrounding water.

In still yet a further embodiment, an outdrive upper drive unit for a watercraft having an inboard engine is provided. The outdrive upper drive unit can include an upper drive unit housing including an upper drive unit bottom. A ball spline can be rotatably disposed in the housing, and the ball spline can be fixedly joined with a driveshaft gear. The ball spline can be joined with a driveshaft and/or an associated connector shaft (collectively referred to as a driveshaft herein). The driveshaft can be linearly movable through the ball spline, but can be rotationally fixed relative to the ball spline so that when the driveshaft gear rotates, the ball spline rotates in unison with the driveshaft gear and the driveshaft. The driveshaft also moves relative to the upper drive unit bottom when it moves linearly through the ball spline.

In even a further embodiment, a method of operating an outdrive is provided. The method can include: rotating an input shaft extending from a transom of a watercraft; rotating a driveshaft that is rotationally coupled to the input shaft, the driveshaft disposed in an upper drive unit; rotating a propeller shaft rotationally coupled to the driveshaft, the propeller shaft joined with a propeller, the propeller shaft rotatably disposed in a lower drive unit; and moving the lower drive unit away from the upper drive unit a preselected distance while rotating the driveshaft and propeller shaft, the moving occurring while the propeller spins and the watercraft is moving through a body of water.

The current embodiments of the watercraft outdrive and related method herein provide benefits in watercraft propulsion that previously have been unachievable. For example, where the outdrive is utilized on watercraft, the adjustability of the lower unit relative to the upper unit vertically allows an operator to lower a thrust point of the propeller to gain leverage and lift the bow of the watercraft. This can assist the watercraft in getting on plane more quickly. Further, with the vertical adjustability of the propeller shaft and lower drive unit in general, a user can adjust upward the thrust point after the watercraft is on plane to reduce drag and increase efficiency and speed.

Where the outdrive is configured to selectively vertically adjust thrust point and general orientation of the propeller shaft, a boat manufacturer can mount an inboard engine in the boat at a lower position in the hull. This can lower the center of gravity of the watercraft, but with the adjustable outdrive, the watercraft can still operate the propeller at the surface of the water on demand.

With the vertical spacing adjustability of the outdrive, the location of the propeller shaft and associated thrust point of the propeller can be changed without disassembling or otherwise mechanically modifying the outdrive. In addition, when the watercraft is loaded with gear, payload and occupants, which alters the buoyancy of the watercraft, an operator can adjust the outdrive, even when the watercraft is under power and moving through the water, to ideally set the propeller shaft location. The operator can also adjust the outdrive depending on the amount of fuel in fuel tanks on the watercraft.

The vertical spacing adjustability of the outdrive herein can enable a user to lower a propeller shaft when entering a turn. This in turn increases drag and slows the boat more quickly. With a lowering of the lower unit of the outdrive, the outdrive also has more skeg and surface area in the water, which can prevent the boat from spinning out when traversing turns at high speed. Accordingly, boats equipped with such an outdrive can traverse turns at a higher rate of speed. Further, after the boat leaves the turn and straightens its path, the user can raise the propeller shaft to again obtain a high rate of speed.

The vertical spacing adjustability of the outdrive herein can assist in movement of the watercraft in reverse. For example, a user can lower the lower drive unit to adjust the propeller shaft and propeller location relative to the bottom of the watercraft. In effect, the lower unit can be lowered so that the propeller shaft and propeller are below the bottom of the watercraft, where the thrust can easily pass under the watercraft, rather than push against the transom of the watercraft.

The vertical spacing adjustability of the outdrive herein also can allow the outdrive to operate in shallow water. For example, with the outdrive, a user can raise the propeller shaft and propeller, which in turn can reduce the required water depth for operation without engaging the propeller against a bottom in the body of water, all while keeping the forward thrust produced by the propeller in line with the watercraft to maximize handling in the shallow water.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
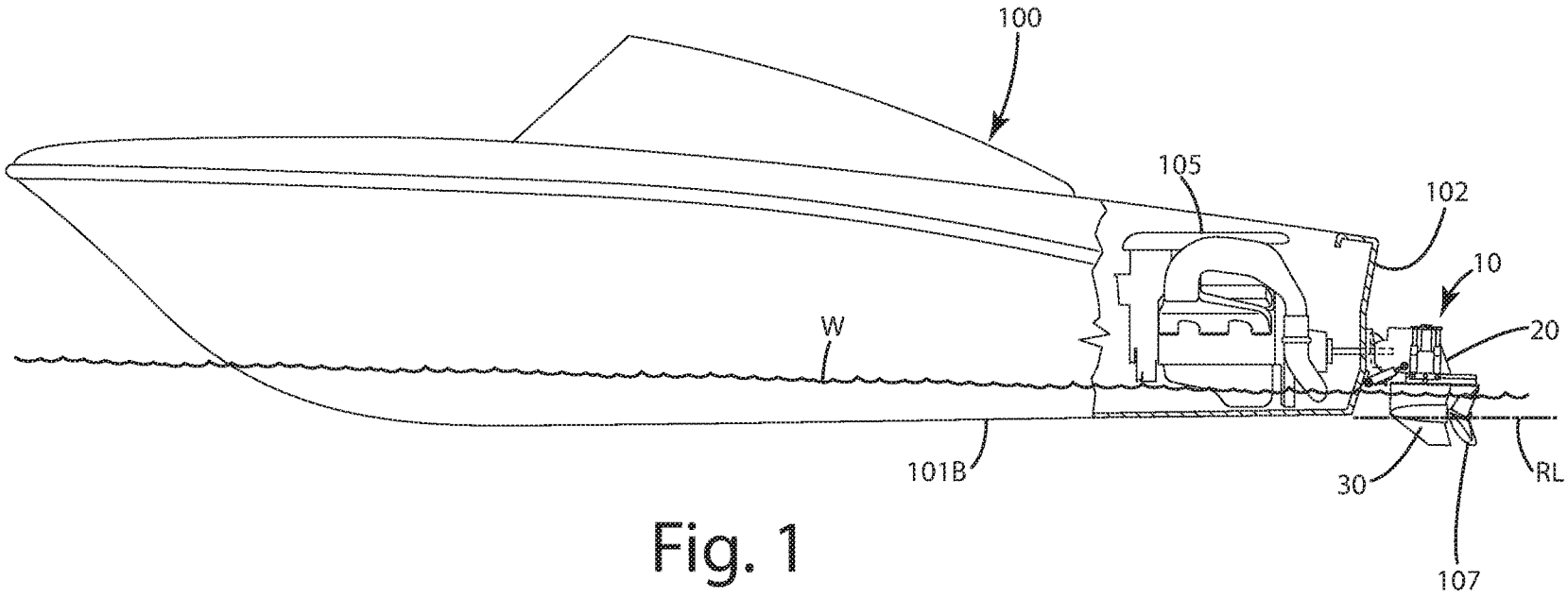
FIG. 1 is a side partial section view of a watercraft including an outdrive of the current embodiment, with the outdrive in a neutral tilt mode and the lower drive unit in a raised mode.

A current embodiment of the watercraft outdrive is illustrated in FIGS. 1-16, and generally designated 10. As illustrated in FIGS. 1-6, the outdrive 10 is joined with a watercraft 100. Although shown as a high performance boat, the watercraft 100 with which the outdrive 10 is used can be any type of marine vessel, for example, a recreational boat, a racing boat, a pontoon boat, a fishing vessel, a tanker or other type of commercial vessel, a submarine, a personal watercraft, an amphibious vehicle, an underwater exploration vehicle, or virtually any other type of vessel that is propelled through or on water via a propeller.

The watercraft 100 includes a hull 101 having a stern 104 at which a transom 102 is located. The hull 101 also includes a bottom 101B. This bottom can coincide with or include a lowermost portion of the hull. The watercraft can include a reference line RL that extends rearward from the hull 101, and in particular, that extends from the lowermost portion of the transom 102 and/or bottom 101B, rearward from the boat. As used herein, this reference line RL is helpful in appreciating the spatial orientation of the propeller shaft 33, which includes its own longitudinal axis LA, relative to the lowermost portion of the transom and/or the bottom 101B of the watercraft.

Within the hull 101, an engine or motor 105 is disposed. With this configuration, the watercraft 100 is considered an inboard type of watercraft, where the engine is mounted inside the hull, rather than hanging off the back of the hull or otherwise disposed outside the hull, as is the case with an outboard motor. The engine is joined with an input shaft 106 that extends rearwardly from the engine and through a hole 102H in the transom 102. The hull hole 102H is sealed so that water cannot enter through the hole into the hull. A bearing (not shown) can also be associated with the hull hole. The input shaft is rotated by the engine under force and generally is utilized to rotate the various components of the outdrive 10 and ultimately the propeller 107 as described below. Further, it will be understood that although referred to as an input shaft, this component can include multiple shafts or members connected to one another via different joints, such as universal joints. If there is more than one shaft connected to others, collectively, those shafts are still considered an input shaft.

The input shaft 106 extends rearward and is rotationally coupled to the components of the outdrive 10. The input shaft can include one or more articulating joints, such as universal joints, depending on the application. Many components of the outdrive 10, as explained below, can be rotationally coupled to one another and directly or indirectly rotationally coupled to the input shaft 106. As used herein, rotatably coupled means that rotation of one element causes rotation of another element, regardless of whether the two elements are in direct contact with one another or have other elements therebetween, so that the two elements do not directly contact or engage one another during rotation.

The outdrive 10 can be mounted to the watercraft, and in particular, the transom 102 via a mounting bracket 11. The mounting bracket 11 can interface directly with the transom 102 with a gasket or seal therebetween to prevent water from entering the input shaft hole 102H or other fastener holes used to connect the mounting bracket 11 to the transom. The mounting bracket 11 can be oriented to enable the input shaft 106 to extend between portions of it or through it, and directly to the outdrive 10. The mounting bracket can be outfitted with an armature or gimbal ring 12 that extends downward as shown, or alternatively upward (not shown). This armature or gimbal ring 12 provides turning of the outdrive as well pivoting of the outdrive during a tilting operation. The gimbal ring can form a portion of a tilt assembly 40 as explained with further reference to FIGS. 3 and 4. The gimbal ring 12 also can be joined with a bell 109 that is fixed to the gear drive unit 20.

The tilt assembly 40 can include a tilt actuator 41 that can extend between the gimbal ring 12 and another portion of the outdrive 10. For example, the tilt actuator 41 can be joined pivotally with the armature 12 at one end 43, and at an opposite end 42, the tilt actuator can be joined with an upper drive unit 20. The actuator 41 can be in the form of a hydraulic ram, pneumatic ram, or a set of gears. The tilt actuator 41 can be remotely operated by a user or operator of the watercraft 100 to extend and/or retract the actuator at its ends relative to one another. In so doing, the tilt assembly 40 operates to tilt the outdrive 10 relative to the watercraft.

Figure 3:
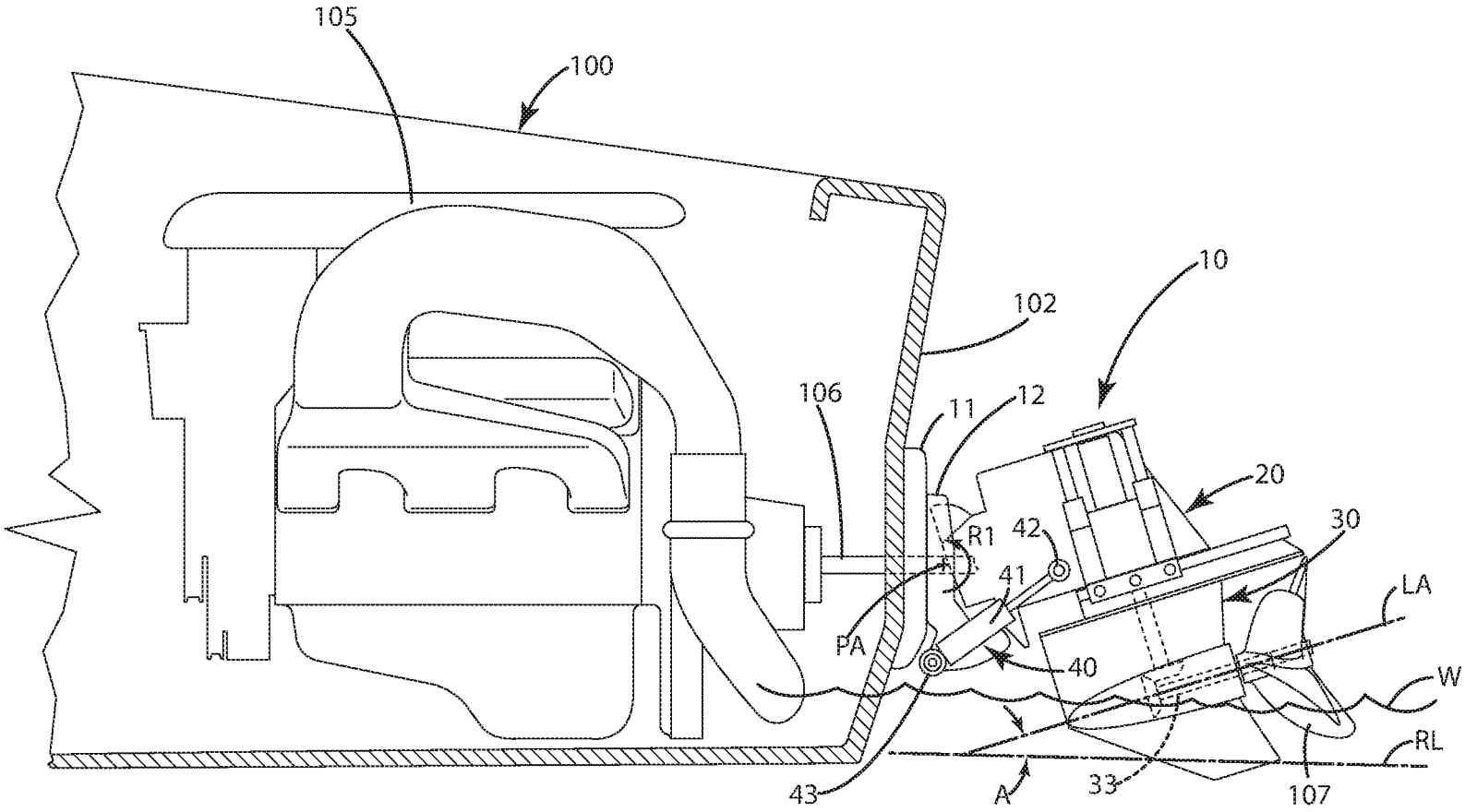
FIG. 3 is a side partial section view of a watercraft including the outdrive with the outdrive in an upward tilted mode and the lower drive unit in a raised mode.

In particular, the tilt assembly 40 can be operated to extend the tilt actuator 41 as shown in FIG. 3. In so doing, the actuator 41 effectively pushes and tilts the outdrive 10 upward. As the outdrive tilts, it pivots about one or more pivot axes PA, at which the outdrive upper unit 20 is attached to a bell, which is attached to a gimbal ring 12 which attaches to the mounting bracket 11. When the outdrive tilts, for example, in direction R1 in FIG. 3, the orientation of the shaft propeller shaft 33 and its longitudinal axis LA attains an angle A that is offset relative to the reference line RL. This upwardly offset angle can vary, depending on the operator's intended propulsion utilizing the propeller 107. In most cases, this upward tilt angle A can be an acute angle.

Figure 1A:
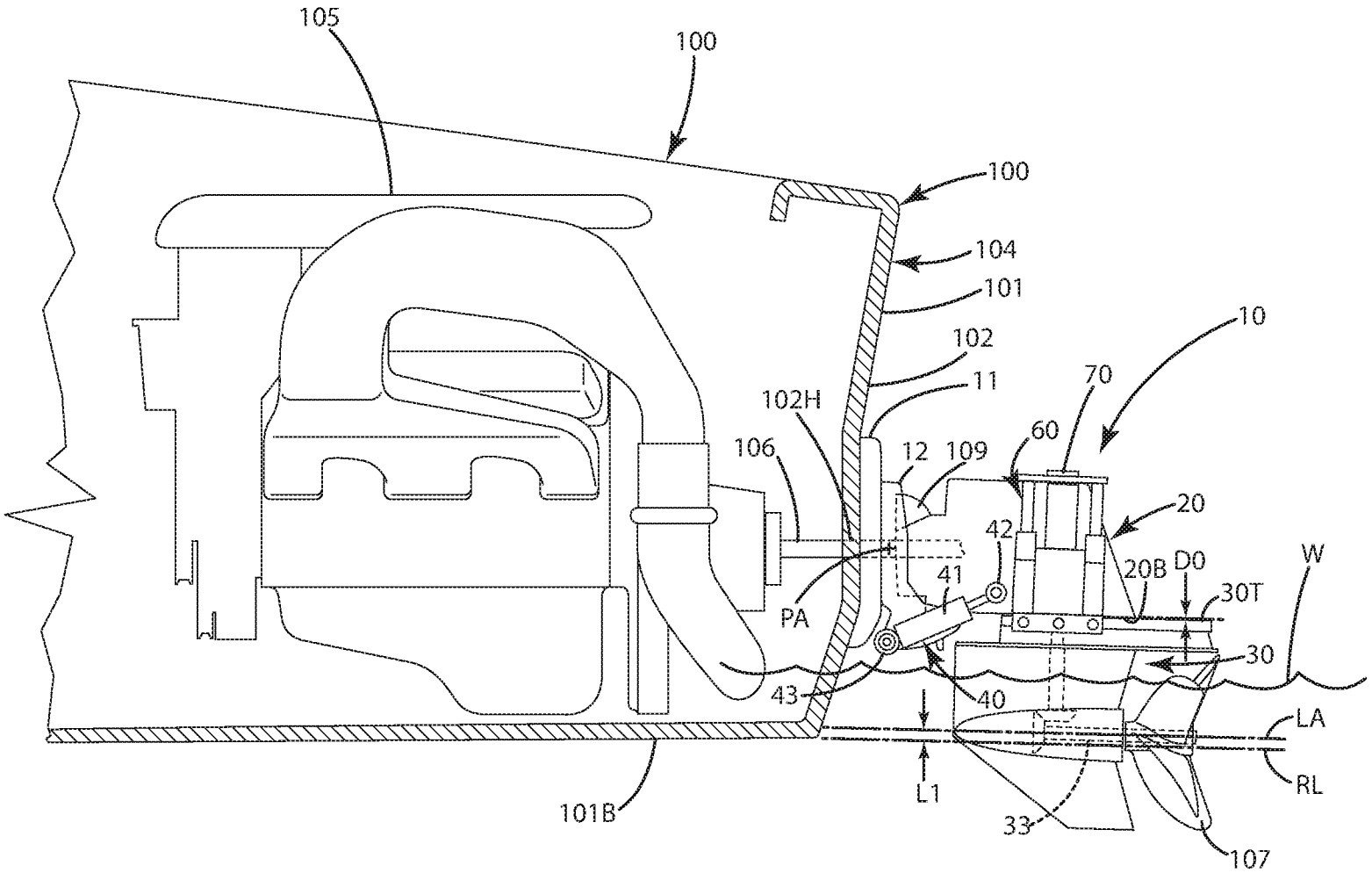
FIG. 1A is a close up section view of the watercraft and outdrive with the outdrive in a neutral tilt mode and the lower drive unit in a raised mode.

The tilt assembly 40 can be adjusted so that the tilt is neutral, as shown in FIG. 1A. This can mean that the propeller shaft 33 and its longitudinal axis LA are parallel to a portion of the hull of the watercraft. For example, the longitudinal axis LA can be parallel to the reference line RL and/or to the bottom 101B of the watercraft when the tilt is neutral. Of course, when the tilt assembly 40 is actuated to tilt the outdrive using the tilt actuator 41, pivoting in direction R1 about axis PA, the outdrive 10 and its components, the upper drive unit 20 and lower drive unit 30 tilt upward changing the orientation of the propeller shaft 33 and its longitudinal axis relative to the reference line RL to some angle A as shown in FIG. 3.

Figure 4:
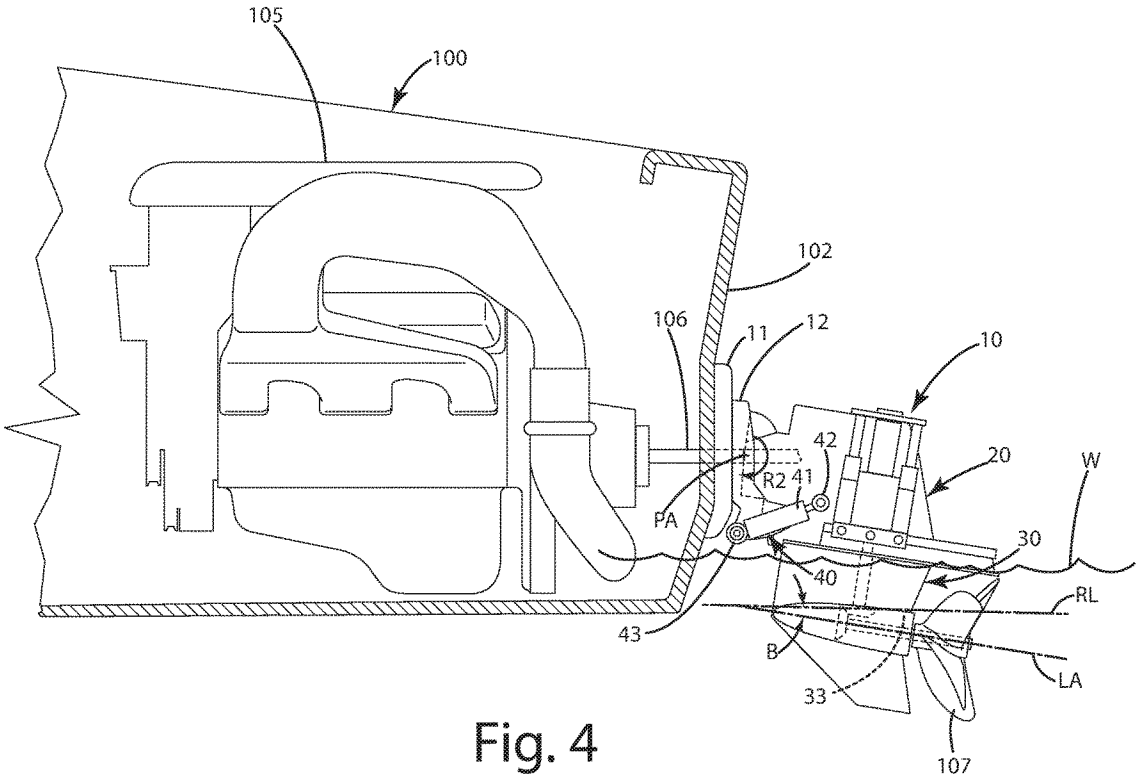
FIG. 4 is a side partial section view of a watercraft including the outdrive with the outdrive in an downward tilted mode and the lower drive unit in a raised mode.

As shown in FIG. 4, the tilt assembly 40 can also be adjusted so that the outdrive and propeller are tilted downward. For example, the tilt assembly 40 can actuate the tilt actuator 41 thereby bringing the ends 42 and 43 closer to one another. This actuator can be in the form of a ram or rod retracting into a hydraulic cylinder. This rotates the outdrive 10 about the pivot axis PA in direction R2. In so doing, the lower drive unit 30 can come closer to the bottom portion of the transom. Further, the propeller shaft 33 and its longitudinal axis LA tilts downward to an offset angle B relative to the reference line RL. This downwardly offset angle can vary, depending on the operator's intended propulsion utilizing the propeller 107. In most cases, this downward tilt angle B can be an acute angle.

In addition to the tilt assembly 40, the outdrive 10 of the current embodiment can include a drive assembly 50, a guide assembly 60 and a vertical adjustment assembly 70. All of these components can operate in concert to enable an operator to raise and lower a lower drive unit 30 in a linear, non-pivoting manner relative to an upper drive unit 20, optionally while the drive is under power to propel a watercraft through water. More particularly, the outdrive of the current embodiment is constructed so that the lower drive unit 30 can be operable in a raised mode as shown in FIG. 1A. There, the lower drive unit 30 is a distance D0 from the upper drive unit 20. This distance D0 can be optionally 0 inches, further optionally less than 1 inch, even further optionally less than ½ inch. As a more particular example, the bottom 20B of the upper drive unit 20 can be adjacent and/or contacting a top 30T of the lower drive unit 30 or the top of the plate 60P when included. Optionally, the upper drive unit and/or lower drive unit can be movably joined with one another but unable to pivot or move about one another or relative to one another in arcuate paths. They can instead move substantially only linearly relative to one another, that is, linearly toward one another or away from one another. Even further optionally, the bottom 20B of the upper drive unit 20 can remain parallel to the top 30T of the lower drive unit during the vertical linear displacement of these surfaces toward and/or away from one another. Further optionally, when moved from the raised mode to the lowered mode and vice versa, the lower unit does not rotate relative to the upper unit about any axes of rotation. Likewise, the upper unit does not rotate relative to the mounting bracket, unless the drive unit is also undergoing tilting with the tilt assembly.

In the raised mode, the propeller shaft 33 and its longitudinal axis LA can be aligned in parallel to the reference line RL, particularly when the outdrive is in a neutral tilt position, as shown in FIG. 1A. In some cases, the longitudinal axis LA can be generally parallel to and/or in a plane within which the reference line RL lies in this raised mode. In other cases, the longitudinal axis LA can be disposed a preselected distance L1, for example, 0, 1, 2, 3, 4, 5, 6 inches or increments thereof above the reference line RL. Optionally, the longitudinal axis LA can be disposed a small preselected distance L1, for example, 0, 1, 2, 3, 4, 5, 6 inches or increments thereof below the reference line RL in the raised mode shown in FIG. 1A.

Figure 2:
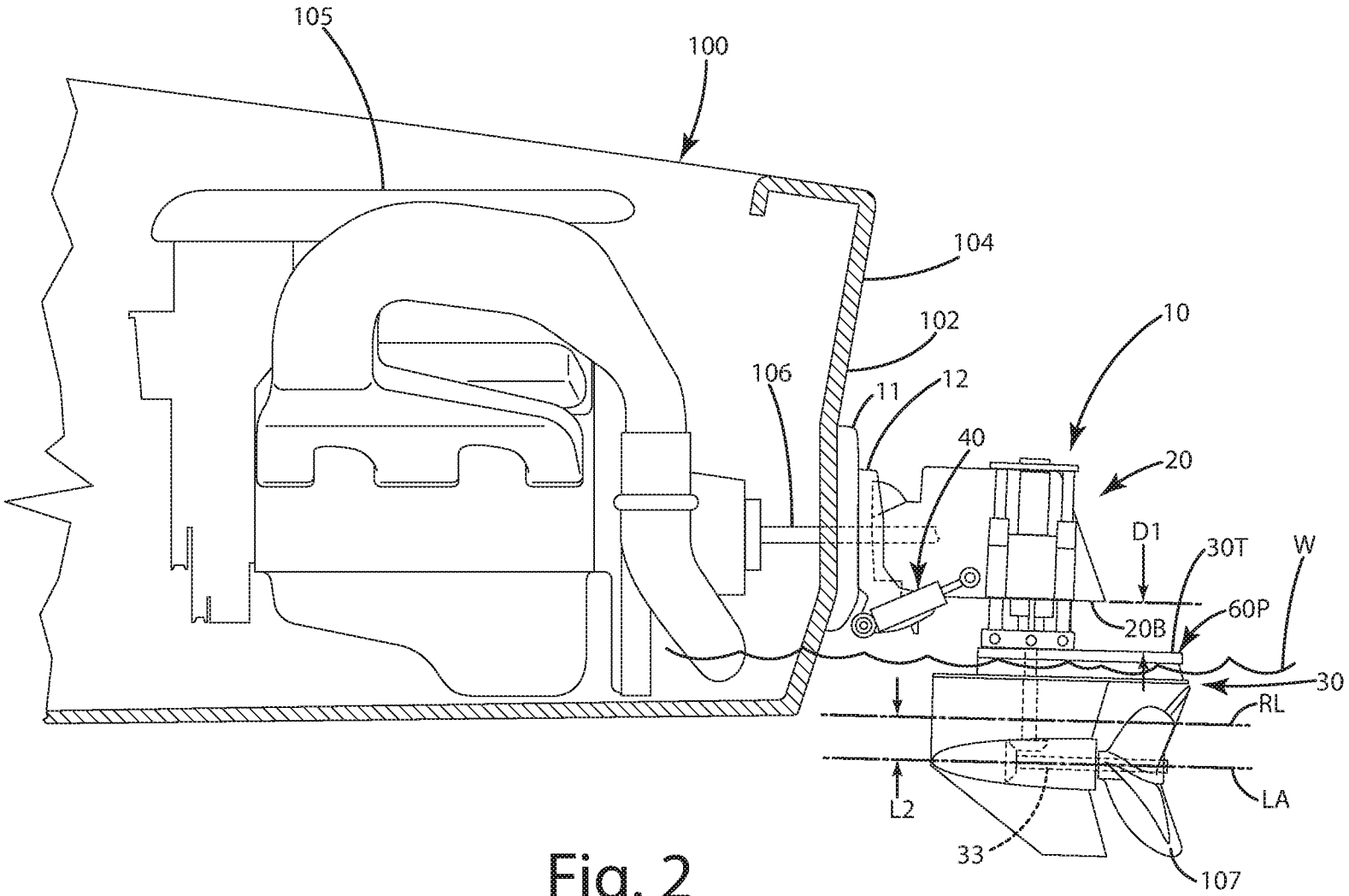
FIG. 2 is a side partial section view of the watercraft including the outdrive, with the outdrive in a neutral tilt mode and the lower drive unit in a lowered mode.

The lower drive unit 30 can be guided and urged with the vertical adjustment assembly 70 and the guide assembly 60 to a lowered mode as shown in FIG. 2. In this lowered mode, the lower drive unit 30 extends away from and moves away from the upper drive unit 20 in a substantially linear manner, without pivoting relative to the upper drive unit, to a preselected distance D1. In effect, this distance D1 can be the distance between the bottom 20B of the upper drive unit 20, or some other reference location on the upper drive unit, and the top 30T and/or the top of the plate 60P of the lower drive unit, or some other reference location on the lower drive unit. This distance D1 is greater than D0. D1 can be optionally, 0, 1, 2, 3, 4, 5, 6 inches or increments thereof.

In this lowered mode, the propeller shaft 33 and its longitudinal axis LA can be aligned in parallel to the reference line RL, particularly when the outdrive is in a neutral tilt position, as shown in FIG. 2. In some cases, the longitudinal axis LA can be parallel to a plane within which the reference line RL lies in this lowered mode. In other cases, the longitudinal axis LA can be disposed a preselected distance L2, for example, 0, 1, 2, 3, 4, 5, 6 inches or increments thereof below the reference line RL. Optionally, the longitudinal axis LA can be disposed a small preselected distance L2, for example, 0, 1, 2, 3, 4, 5, 6 inches or increments thereof above the reference line RL in the lowered mode shown in FIG. 1A.

The lower drive unit 30 is movable from the raised mode to the lowered mode while the watercraft 100 is moving through a body of water W and while the propeller shaft 33 and the propeller 107 are spinning and producing thrust to propel the boat in a direction. The lower drive unit 30 is movable toward and away from the upper drive unit, optionally linearly, while the watercraft is moving through a body of water and while the propeller shaft 33 and the propeller 107 are spinning and producing thrust. Further, the spatial offset of the longitudinal axis LA from the distance L1 to a second, different distance L2 (in transitioning from the raised mode to the lowered mode) can all occur while the watercraft is under power and the propeller is spinning. The various components of the drive assembly 50, for example the driveshaft, connector shaft, or other components as described below also can move relative to the upper drive unit bottom and/or the lower drive unit top 30T in the transition from the raised mode to the lowered mode and vice versa, all while the propeller is spinning and the watercraft is moving and/or under power.

During the movement of the lower drive unit 30 relative to the upper drive unit 20, for example, as shown in FIGS. 1A and 2, the spacing between the longitudinal axis LA of the propeller shaft 33 changes relative to the reference line RL. Again, in the raised mode the spacing between the reference line RL and the longitudinal axis LA of the propeller shaft 33 can be a distance L1. When the lower drive unit 30 is lowered relative to the upper drive unit 20, this vertical spacing changes so that the longitudinal axis LA of the propeller shaft 33 is spaced a second, optionally greater distance, L2 (FIG. 2) from the reference line RL. It will be noted that during this transitional movement and alteration of the spacing of the longitudinal axis LA shaft 33 relative to the reference line RL, the longitudinal axis LA maintains a constant angular orientation relative to the reference line RL (assuming that the tilt assembly is not simultaneously actuated during the raising and lowering).

Accordingly, assuming the tilt is neutral as shown in FIG. 1, when the lower drive unit 30 is moved to the lowered mode shown in FIG. 2, the longitudinal axis LA of the propeller shaft 33 remains in a parallel configuration relative to the reference line RL. If the outdrive is in an upward tilted mode as shown in FIG. 3, when lowering from a raised mode to a lowered mode of the lower drive unit 30 occurs, the longitudinal axis LA of the propeller shaft 33 can be maintained at the offset angle A relative to the reference line RL throughout the vertical spacing adjustment or downward movement. If the outdrive is in a downward tilted mode, as shown in FIG. 4, when lowering from a raised mode to it lowered mode of the lower drive unit occurs, the longitudinal axis LA of the propeller shaft 33 can be maintained at the offset angle B relative to the reference line RL throughout the vertical spacing adjustment or downward movement. Likewise, in the first operation, where the lower drive unit 30 is moved from the lowered mode to the raised mode, the longitudinal axis LA can maintain its angular orientation relative to the reference line RL throughout the movement.

Optionally, during the movement of the lower drive unit 30 relative to the upper drive unit 20, for example, as shown in FIGS. 1A and 2, the upper drive unit 20 remains in a fixed orientation relative to the mounting bracket and/or gimbal ring. For example, the upper drive unit 20 and its housing 20H do not pivot up or down relative to these components.

The various components of the outdrive 10, for example the various housings, the upper drive unit 20 and lower drive unit 30, the guide assembly 60, the vertical adjustment assembly 70, the drive assembly 50, and a shaft seal assembly 80 will now be described in more detail. As shown in the exploded view of FIGS. 8 and 9, the outdrive 10 can include an upper drive unit 20. The upper drive unit 20 can include an upper drive unit housing 20H within which various components of the drive assembly, vertical adjustment assembly and guide assembly can be at least partially housed. The housing 20H can be divided into forward 20F and rearward 20R blocks. These different blocks can allow disassembly of the housing, and access to the various different assemblies and their components in an easy manner. The input shaft 106 can extend into the housing 20H in particular the forward block 20F, and can interface with the drive assembly as explained further below. The upper drive unit 20 can include a cover plate 20P that can cover and conceal the various components of the drive assembly 50, for example, the gears 50G1, 50G2 and 50G3 as explained further below. The housing 20H can include one or more guide shaft bores 60GSB that are configured to guide the elongated guide shafts 60S1 and/or 60S2 in a linear manner, thereby guiding the lower drive unit 30 away from and toward the upper unit 20 in a consistent, even and stable manner when the watercraft 100 is under power. The upper drive unit 20 and its housing 20H can include an upper drive unit bottom 20B relative to which a driveshaft and/or connector shaft of the drive assembly 50 move in transitioning from a raised mode to a lowered mode and vice versa.

Figure 9:
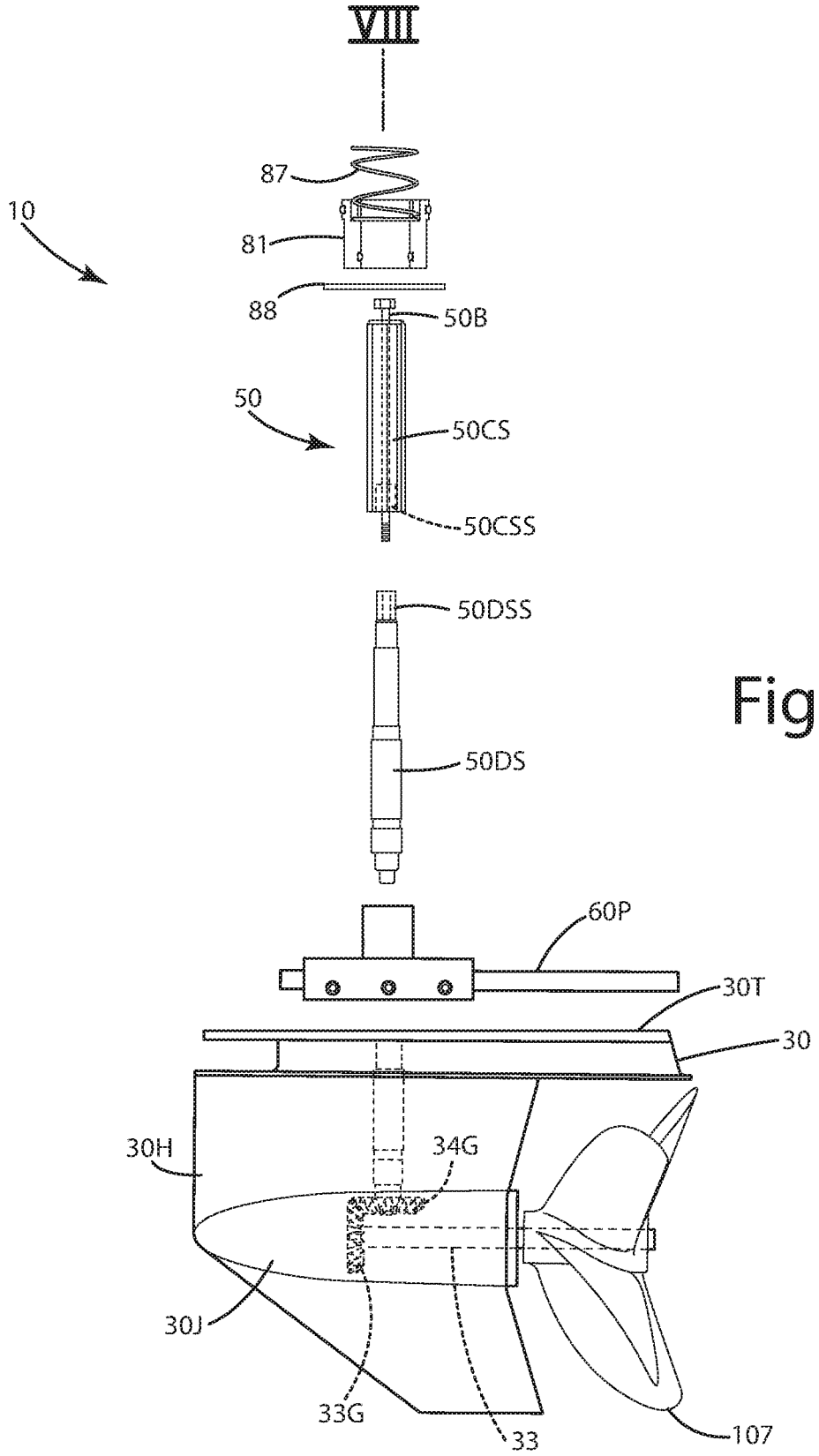
FIG. 9 is an exploded view of a portion of the drive assembly, vertical adjustment assembly and the lower drive unit with a propeller.
Figure 10:
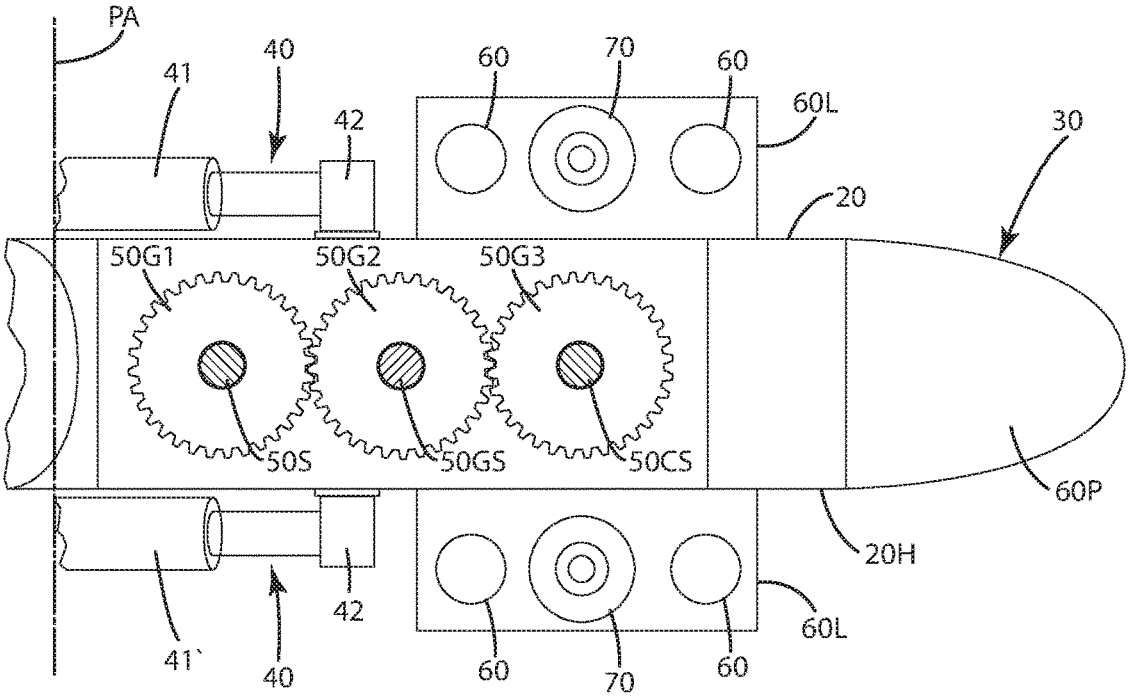
FIG. 10 is a top view of the upper drive unit, and in particular a clutch gear, an idler gear and a driveshaft gear, along with portions of the guide assembly and tilt assembly.
Figure 14:
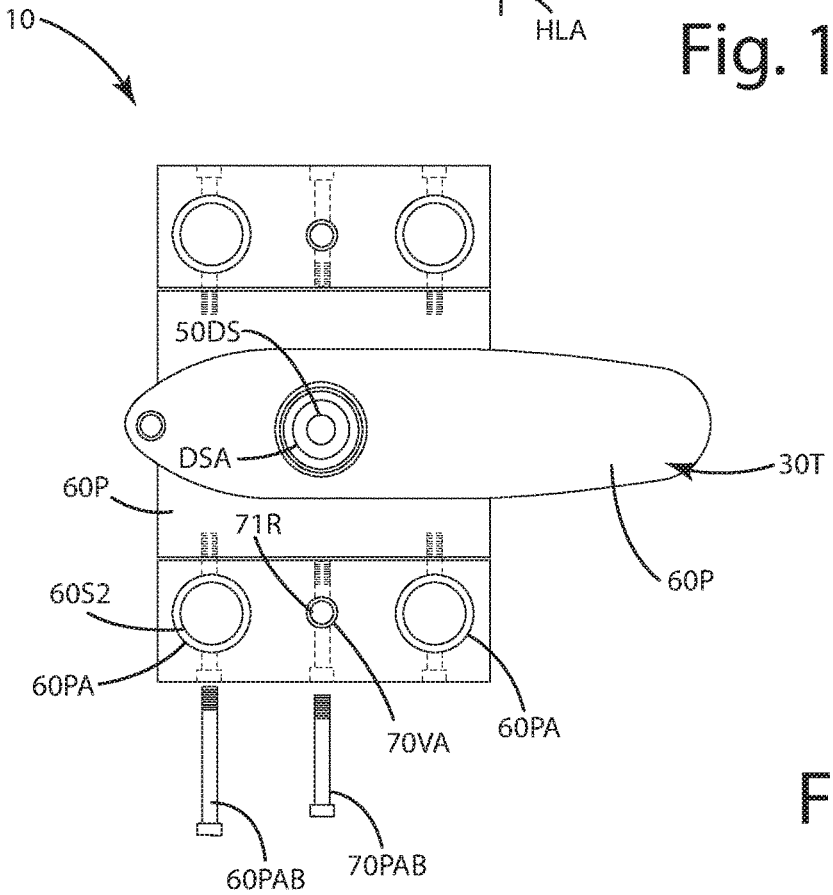
FIG. 14 is a top view of a top of the lower drive unit.

The lower drive unit 30 of the outdrive 10 can include a lower drive unit housing 30H, as shown in FIG. 9. This housing can include a bullet or torpedo 30J that houses the propeller shaft 33 and associated gear 33G, which interfaces with the gear 34G that is connected to the driveshaft of the drive assembly 50. The lower drive unit 30 can also include the propeller 107 which is fixedly and non-rotatably joined with the propeller shaft 33. The lower drive unit 30 can include a lower drive unit top surface 30T. Referring to FIG. 14, the lower drive unit 30 can include a guide assembly plate 60P. This guide assembly plate 60P can extend laterally from first and second sides of the lower drive unit 30, and can be attached to the top surface of the lower drive unit 30T effectively forming the new top surface of the lower drive unit 30.

The guide assembly plate 60P can include one or more plate apertures 60PA that are configured to receive a portion of the elongated guide shafts 60S2 of the guide assembly. The bottoms of the elongated guide shafts 60S2 can be connected via a fastener, such as a bolt 60PAB that extends through the plate and through the lower end of the elongated guide member 60S2 thereby securing the elongated guide member to the plate. The guide plate 60P as shown in FIG. 14 can include an aperture DSA through which the driveshaft SODS and/or connector shaft 50CS of the drive assembly 50 extends into the housing 30H of the lower drive unit 30.

The plate 60P can include vertical adjustment assembly actuator apertures 70VA. These vertical adjustment assembly actuator apertures 70VA can be configured to receive a portion of the vertical adjustment actuators 71A. For example, where the vertical adjustment actuators 71A are the form of hydraulic cylinders with extending and retracting rams 71R, the ends of the ram can be connected via a fastener, such as a bolt 70PAB, that extends through the plate and through the lower end of the ram 71R thereby securing the ram to the plate. Optionally, although shown as a separate plate 60P, the guide assembly plate 60P can be integral with the lower drive unit housing 30 or other components of a lower drive unit. Further optionally, the plate can be set up with a different set of apertures to handle a different number of elongated guide members 60S2 and/or different types of vertical adjustment actuators 71A.

With reference to FIGS. 8-14, the components and operation of the guide assembly 60 and the vertical adjustment assembly 70 be described in further detail. To begin, the vertical adjustment assembly 70 is the component of the outdrive that moves the lower unit relative to the upper unit and/or vice versa. Depending on the particular application, the various components of the vertical adjustment assembly can be disposed substantially on or in the upper drive unit or the lower drive unit. For the applications herein, however, most of the components are disposed on or in the upper drive unit. Further, the vertical adjustment assembly can be operated remotely, for example, from a cabin or at an operator station via electrical, manual, hydraulic pneumatic or other controls to provide the desired raising and/or lowering of the lower drive unit relative to the upper drive unit.

Figure 11:
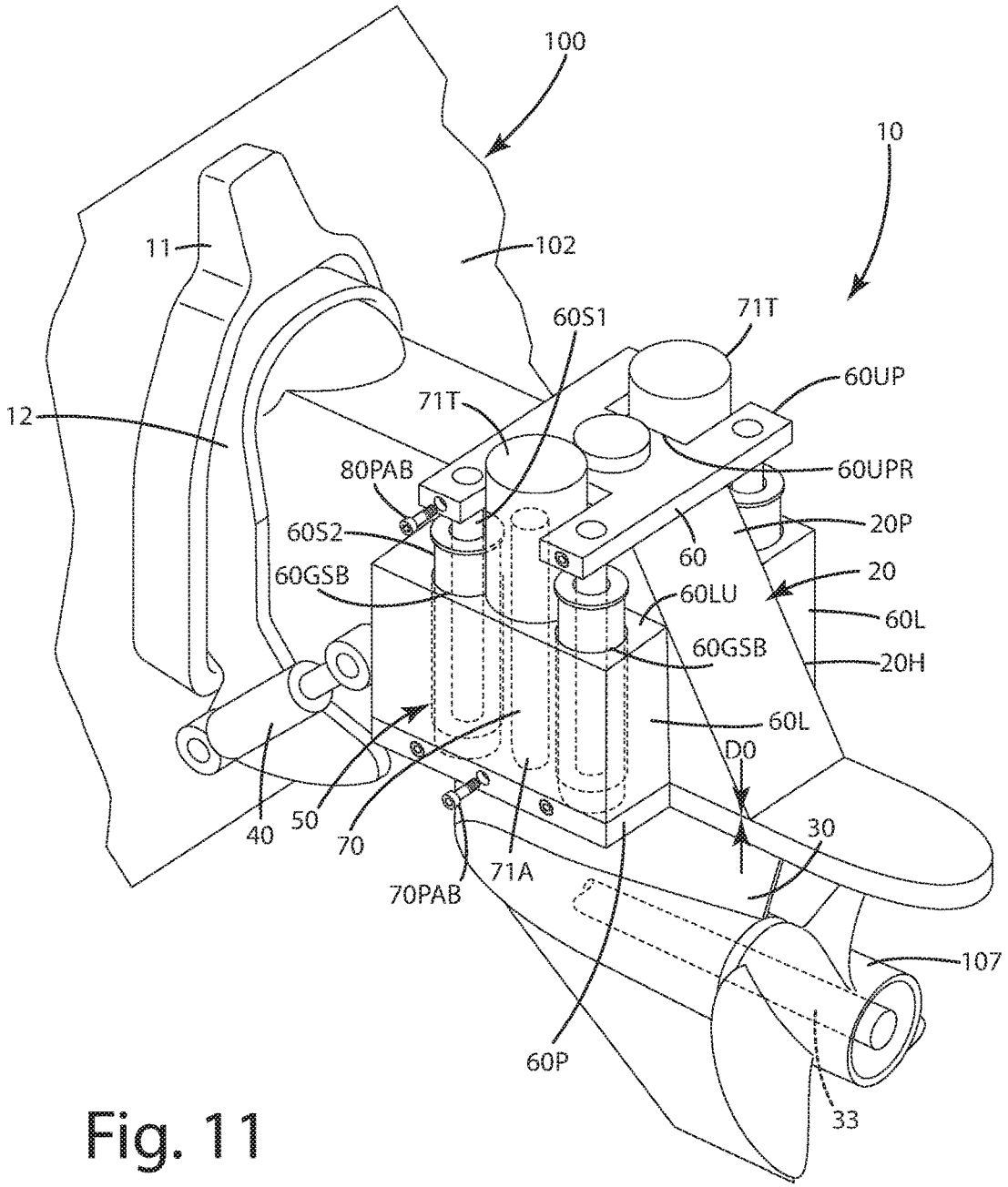
FIG. 11 is a perspective view of the guide assembly and a vertical adjustment assembly with the lower drive unit in a raised mode.
Figure 12:
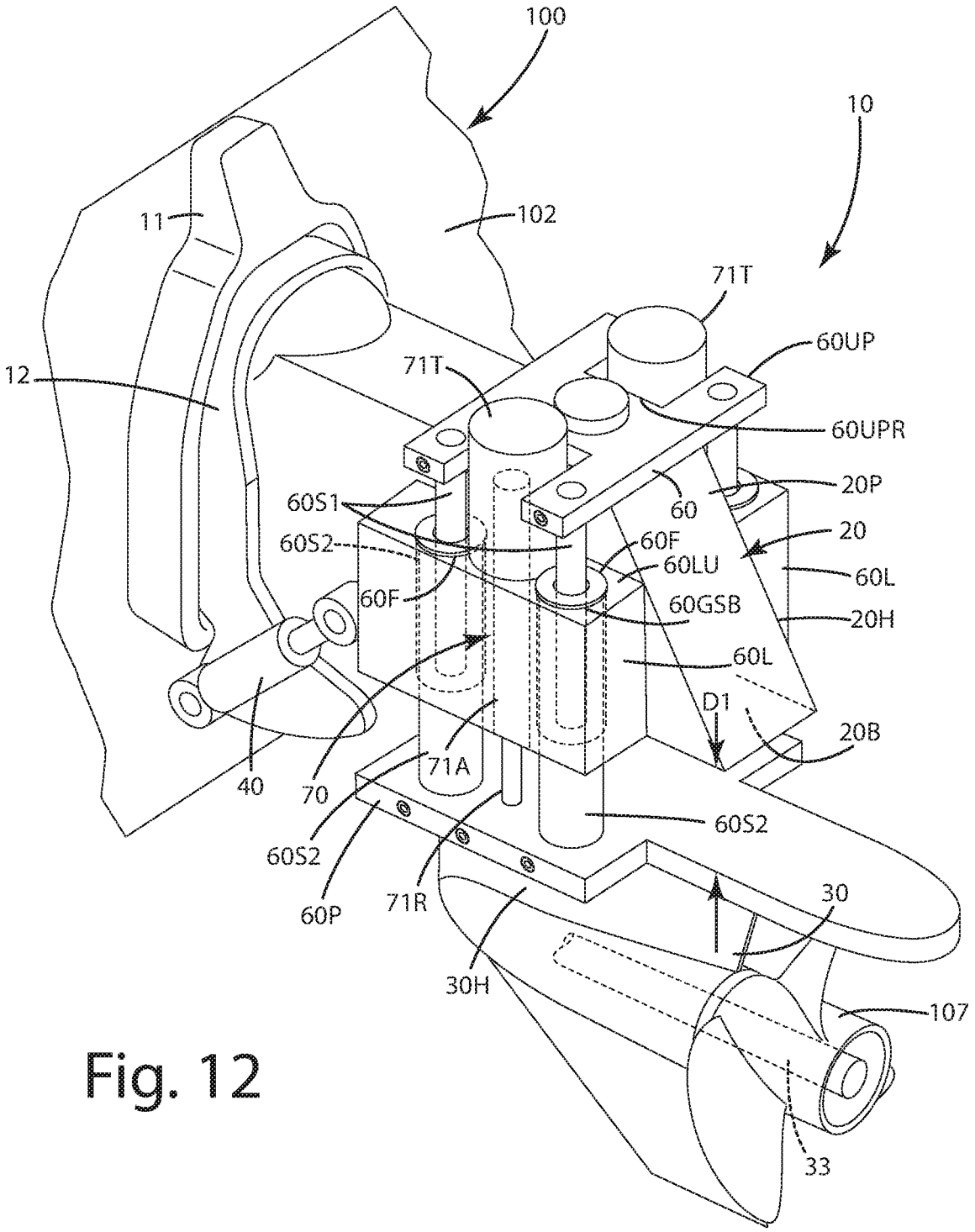
FIG. 12 is a perspective view of the guide assembly and the vertical adjustment assembly with the lower drive unit in a lowered mode.
Figure 13:
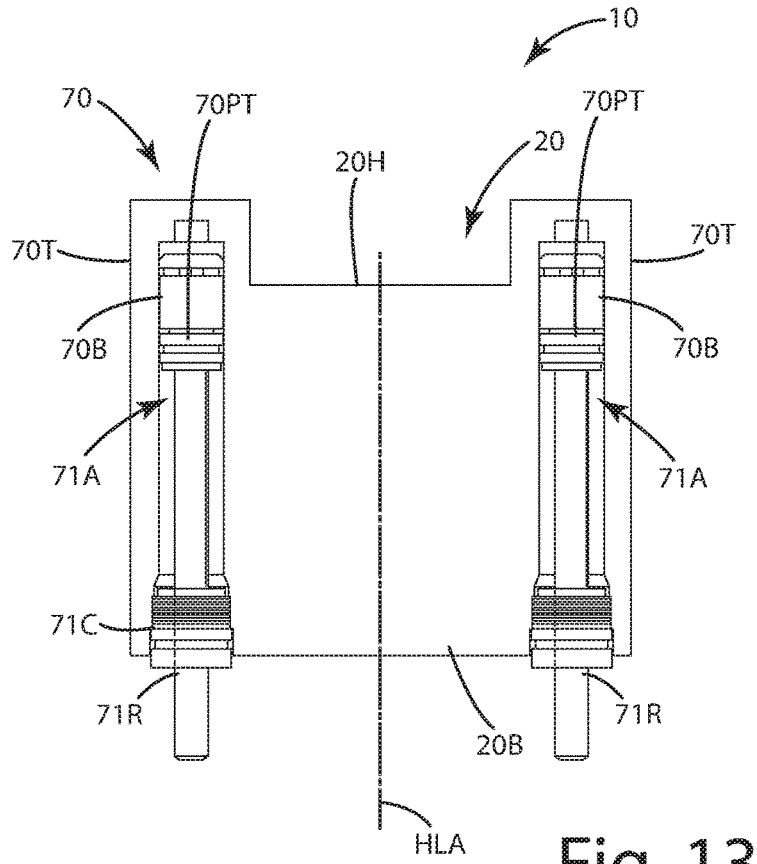
FIG. 13 is a rear view of the upper drive unit and portions of the vertical adjustment assembly.

As shown in FIGS. 11-13, the vertical adjustment assembly 70 can include first and second towers 71T disposed on opposing left and right sides of a housing longitudinal axis HLA of the housing 20H of the upper drive unit 20. These towers 71T can be formed as actuators 71A defining internal bores 70B. Within these internal bores, a piston 70PT and ram 71R can be disposed. As mentioned above, these actuators 71A can be in the form of hydraulic, pneumatic or other types of actuators, with rams 71R that extend and retract relative to a main body of the towers 71T. The amount of force with which the rams 71R extend and retract can vary depending on the particular application and the watercraft. The actuators 71A and towers 71T can be disposed symmetrically across from one another relative to the upper unit housing 20H. This can provide a balanced application of force to raise and lower the lower drive unit 30 relative to the upper drive unit 20. Optionally, the left and right actuators 71A can be in a common fluid or hydraulic circuit so that the actuators simultaneously, consistently and evenly engage the guide assembly plate 60P and/or the lower housing to move it in an even and level manner upward and downward to and from the various modes.

As shown in FIG. 13, the ram 71R and piston 70PT of actuators 71A can be located in respective bores 70B of the towers. The actuators 71A can include a threaded cap 71C that allows the ram or rod 71R to extend through it. Cap 71C optionally can include a special seal to prevent liquid from passing by the cap and into the bore 70B or vice versa. As mentioned above, ram 71R can be fixedly pinned at its lowermost end to the guide assembly plate 60P using fasteners 70PAB. Of course, other attachment mechanisms can be utilized. Generally the towers 71T remain stationary relative to the upper drive unit, while the rams 71R extend and retract relative to the upper drive unit 20 and move relative to the upper drive unit bottom 20B.

Although not shown, the towers 70T, within which actuators are disposed, can be placed on the lower drive unit 30 along with the actuators so that the ram engages portions of the upper drive unit 20 to move the assembly. Of course with this configuration, the lower drive unit can become particularly large and cumbersome, which is why the vertical adjustment assembly 70 can be contained in and associated with the upper drive unit shown, mostly out of the water when the boat is under power and moving at speed.

Figure 8:
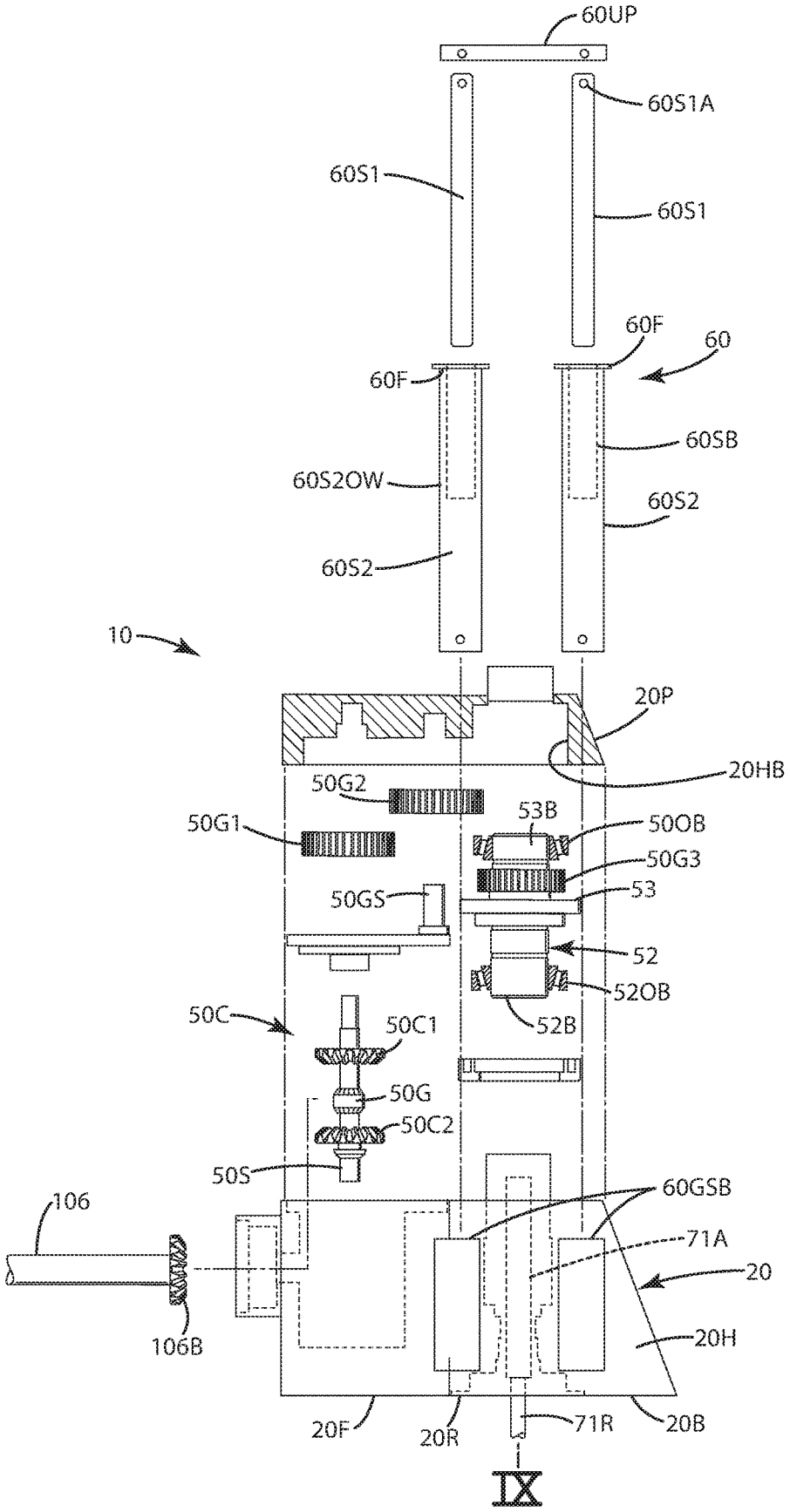
FIG. 8 is an exploded view of the upper drive unit, guide assembly, vertical adjustment assembly and a portion of the drive assembly.

The guide assembly 60 can operate in concert with the vertical adjustment assembly 70 to provide a smooth, guided, and even consistent raising and lowering of the lower drive unit relative to the upper drive unit and vice versa. As shown in FIGS. 8 and 11-12, the guide assembly 60 can include multiple guide shafts 60S1 and 60S2. The guide shaft 60S1 can be a solid rod or bar, and generally can be referred to as a primary guide shaft. This primary guide shaft 60S1 fits into a bore 60SB of a secondary guide shaft 60S2. This fitment can be in a telescoping manner so that the primary guide shaft 60S1 can move within the bore 60SB of the secondary guide shaft 60S2 in a telescoping manner. With the interaction of the primary and secondary guide shafts, there is some redundancy and extra strength provided to the guide shaft in general, which can provide a more solid connection between the upper and lower units, even when extended to the lowered mode. Incidentally, as used herein the term guide shaft can refer to the primary guide shaft, the secondary guide shaft, or a combination of the two, or a single guide shaft where primary and secondary guide shafts are not utilized, or any other combination of multiple guide shafts.

As shown in FIGS. 8 and 11-12, the primary guide shafts 6051 are joined with an upper guide shaft plate 60UP. This attachment can be via fasteners 80PAB that pass through apertures 60S1A of the ends of the primary guide shaft 60S1. Of course, other mechanisms or fasteners can be used to attach these elements to the plate. The top plate 60UP can extend above a cover 20P of the upper drive unit 20H and can be disposed above the top of the housing 20H. The top plate 60UP can include recesses 60UPR within which the towers 71T of the vertical adjustment assembly 70 extend. Although shown as a separate plate, this upper guide shaft plate 60UP can be integrally formed with the cover 20P and/or the remainder of the housing 20H, depending on the application.

The upper drive unit 20 also can define guide shaft bore 60GSB as shown in FIGS. 8 and 11. One or more of the guide shafts 60S1 and 60S2 can be disposed slidably and/or movably within these guide shaft bores 60GSB. The secondary guide shafts 60S2 can be received in and move in a telescoping manner relative to the guide shaft bores 60GSB when the lower drive unit 30 moves relative to the upper drive unit 20. Optionally, the primary guide shafts 60S1 can remain in a stationary and fixed relationship relative to the guide shaft bores 60GSB while the secondary guide shafts 60S2 move relative to the guide shaft bores 60GSB. In addition, during this movement, the secondary guide shafts can move and telescope relative to the primary guide shafts. Of course, with other setups of guide shafts or fewer guide shafts, depending on the application, different guide shafts can move relative to the guide shaft bores 60GSB. These guide shaft bores 60GSB can be defined in the lateral extensions 60L the housing 20H of the upper drive unit 20. They can be constructed to be relatively stout and withstand significant forces, due to the forces that the lower housing unit 30 may be placed under in operation.

Optionally, the secondary guide shafts 60S2 can include an upper flange or lip, also referred to as a shoulder 60F. This shoulder 60F can extend outwardly from the outer wall 60S2OW of the secondary guide shaft preselected distance. This flange or shoulder 60F can engage a surface 60LU of the lateral extension 60L thereby arresting and stopping movement and extension of the guide shaft relative to the upper drive unit 30. This in turn arrests downward movement of the lower unit. The particular spacing of the shoulder 60F can be selected to provide a desired amount of vertical spacing of the lower unit relative to the upper unit upon lowering to the lowered mode. This is illustrated in FIG. 12, where the shoulders 60F engage the upper surface 60LU of the lateral extensions 60L of the housing 20H. At this point, the lower unit 33 is prevented from extending any farther distance than the distance D1 from the upper drive unit 20. Optionally, the actuator 71A can be calibrated with the length of the guide shafts so that the ram 71R of the actuator 71A exerts no more force to move the lower drive unit 30 away from the upper drive unit 20 upon engagement of the flanges 60F with the lateral extension 60L of the guide assembly 60.

As further shown in FIG. 12, when the lower drive unit 30 is moved to the lowered mode shown there, portions of the secondary guide shafts 60S2 can extend below the bottom 20B of the upper drive unit 20. This can expose a portion of the secondary guide shaft 60S2 that is approximately the same length as the distance D1 that the lower drive unit 30 moves away from the upper unit 20. Likewise, the ram 71R of the actuator 71A can extend a distance below the bottom 20B of the upper drive unit 20 a similar distance D1. Of course, depending on the configuration of the respective plates and the lateral extensions, the length of exposed shafts 60S2 and exposed ram 71R can vary from the distance D1.

Optionally, although not shown, the guide assembly and vertical adjustment assembly can be configured slightly differently. For example, the primary guide shafts 60S1 can be eliminated. The secondary guide shafts 60S2, as shown in FIG. 12, can be fixed in an immovable manner relative to the lateral extensions 60L. The guide assembly plate 60P can be constructed to include the apertures 60PA, however, the shafts 60S2 are not fixedly secured to the plate 60P. In this construction, the actuator 71A of the vertical adjustment assembly 70 can move the lower unit, in particular the plate 60P, relative to the upper drive unit 20. The shafts 60S2, however, simply slide in telescoping manner within the apertures 60PA of the plate 60P. In this construction, the lower unit housing 30H can be configured to conceal those portions of the secondary guide shafts 60S2 when they project downward from the bottom of the guide shaft assembly plate 60P to improve fluid dynamics.

Optionally, the precise location of the elements and components of the drive assembly and vertical adjustment assembly can be moved relative to one another about the upper drive unit 20. Further, fewer or less of each respective component can be included in the outdrive 10, depending on the particular application. In some cases, it may be satisfactory to include only a single vertical adjustment assembly and associated actuator and a single system of guide shafts relative bores of a guide assembly. In others, additional guide assembly components and vertical adjustment assembly components can be helpful.

As mentioned above, the outdrive 10 includes a drive assembly 50. This drive assembly is configured to enable components thereof to effectively extend and retract relative to the upper housing and/or the lower housing, so that the lower drive unit 30 can be moved to a lowered mode and back to a raised mode, all while the drive assembly conveys rotational force to the propeller 107, and all while the boat is under power, moving through water.

With reference to FIGS. 5-10, the drive assembly 50 includes multiple shafts and gears that are rotationally coupled to one another. To begin, in FIG. 5, the drive assembly 50 and its components are rotated via the input shaft 106 that extends through the transom 102 of the watercraft 100 and ultimately to the engine 105 within the hull of the watercraft. In many applications, the input shaft 106 is constantly spinning, as soon as the engine is started. The input shaft 106 can be configured in a substantially horizontal orientation, and can extend into the housing 20H of the upper drive unit 20. Optionally, the input shaft 106 can include one or more universal joints to accommodate up and down movement, and to also allow for left and right movement. The input shaft 106 can include a bevel gear 106B. This bevel gear 106B can be disposed adjacent and can interface with first and second bevel gears 50C1 and 50C2. This clutch 50C can be a cone clutch, and can be operated with a gear selecting fork (not shown). Via the clutch and the gear selector, a user can remotely (from elsewhere on the watercraft) select neutral, forward, or rearward propulsion via the outdrive. Exemplary cone clutches and gear selectors are disclosed in U.S. Pat. No. 6,960,107 to Schaub and U.S. Pat. No. 6,523,655 to Behara, both of which are incorporated by reference herein in their entirety. Of course, other types of clutches and gear selectors can be utilized. In some limited cases, the clutch 50C can be absent.

As shown in FIG. 8, the clutch 50C can include a clutch shaft 50S. Bevel gears 50C1 and 50C2 can be selectively engaged by the clutch shaft 50S, and an associated clutch element 50G. This cone clutch or clutch element 50G can be moved so that either the first bevel gear 50C1 (for right hand rotation) or the second bevel gear 50C2 (for left hand rotation) are rotatably coupled to the clutch shaft 50S and its clutch shaft gear 50G1. The clutch element 50G also can be moved so that neither of the bevel gears 50C1 or 50C2 are rotatably coupled to the clutch shaft 50S and its gear 50G1, in which case the outdrive can be in neutral, with input shaft spinning freely.

The clutch shaft 50S can be generally vertically oriented and rotatable within the housing 20H of the upper drive unit 20. The ends of the clutch shaft can be constrained by bearing elements or other bores to facilitate rotation of the same. The clutch shaft 50S is also joined with a clutch shaft gear 50G1. This clutch shaft gear 50G1 can be non-rotatably mounted to the clutch shaft so that the clutch shaft and the clutch gear rotate in unison. This clutch shaft gear 50G1 can extend above a portion of the upper unit housing 20H and can be concealed within a compartment defined by the upper cover 20P of the housing. The clutch shaft gear 50G1 can be rotatably coupled to the idler gear 50G2, which is rotatably mounted on a spindle 50GS. The idler gear can be mounted above a portion of the upper unit housing 20H and can be concealed within a compartment defined by the upper plate 20P of the housing. When the clutch shaft gear 50G1 rotates, this idler gear 50G2 also rotates, but in a different direction. The drive assembly 50 can include a driveshaft gear 50G3. This driveshaft gear or connector shaft gear 50G3 can be rotatably coupled to the idler gear 50G2. The driveshaft gear or connector shaft gear 50G3 can be mounted above a portion of the upper unit housing 20H and can be concealed within a compartment defined by the upper cover or plate 20P of the housing.

In operation, the input shaft 106 rotates the clutch shaft 50S, which rotates the clutch shaft gear 50G1. The clutch shaft gear rotates the idler gear 50G2 and the idler gear 50G2 rotates the driveshaft gear 50G3. As explained in further detail below, the driveshaft gear 50G3 is fixed rotationally relative to the driveshaft SODS and/or a connector shaft 50CS. Accordingly upon rotation of the gear 50G3, the driveshaft SODS is rotated, and in turn rotates via the gears 34G and 33G the propeller shaft 33 and the propeller 107. This rotation of all the elements of the drive assembly 50 occurs while the drive assembly is under power and rotating via input from the input shaft 106. The rotation of all these components can occur equally and similarly in both the raised mode and lowered mode of the lower drive unit.

An aspect of the drive assembly 50 is that the driveshaft SODS can move linearly, up and down relative to and through the upper drive unit 20, while still remaining rotatably coupled to the propeller shaft 33. Put another way, the driveshaft can continue to be rotatably coupled to the input shaft 106 and rotate, all while the lower drive unit 30 is in the raised or lowered mode and/or moving somewhere in between, and/or all while the driveshaft moves linearly up and down in the upper unit housing 20H. The driveshaft continues to rotate the propeller 107 while the watercraft is under power and the input shaft 106 is rotating the various components of the drive assembly 50, in either the raised mode, the lowered mode, and during the transition from the raised mode to the lowered mode and vice versa. At all times, the driveshaft can continue to rotate the propeller regardless of the transitioning between the raised and/or lowered modes or vice versa. To do so, the driveshaft SODS and/or a connector shaft 50CS can telescope relative to the upper drive unit 20 and components thereof. Optionally, the driveshaft and/or connector shaft can remain in a fixed orientation relative to the propeller shaft. For example, as shown, the driveshaft can remain at a 90° angle relative to the propeller shaft, regardless of the vertical spacing of the upper unit relative to the lower unit.

The outdrive 10 can include a ball spline 52 that is joined with the driveshaft gear 50G3 in a fixed and non-rotatable manner. As shown in FIGS. 5-8, the ball spline 52 can be joined with the gear 50G3. To do so, the ball spline 52 can include an outer cylinder 520C. The outer cylinder 520C can be joined with a flange 52F, which can be fastened, welded, integrated with or otherwise joined non-rotatably to another flange 53F. This other flange 53F can be joined to a gear cylinder 53C. The gear cylinder 53C can be fixedly and non-rotatably mounted to the gear 50G3. In this manner, all of the components 50G3, 53, 53F, 52F and 520C can be non-rotatably fixed or joined with one another. Accordingly, when the gear 50G3 rotates, the ball spline 52 also rotates.

The ball spline 52 and the gear cylinder 53C, can be rotatably disposed in a ball spline receiver bore 20HB defined by the upper drive unit housing 20H and/or the top plate 20P. In this manner, the ball spline 52, the gear cylinder 53C and the gear 50G3 all can rotate within the housing and in particular within the ball spline receiver bore 20HB. To facilitate this rotation, a first bearing set 52S can be joined with the outer cylinder 520C of the ball spline 52. A second bearing set 53S can be joined with the gear cylinder 53C. These bearing sets 52S and 53S can enable the entire ball spline gear unit 53, which includes the ball spline 52, the gear cylinder 53C, along with the gear 50G3 to rotate within the ball spline receiving cylinder 20HB freely.

Figure 7:
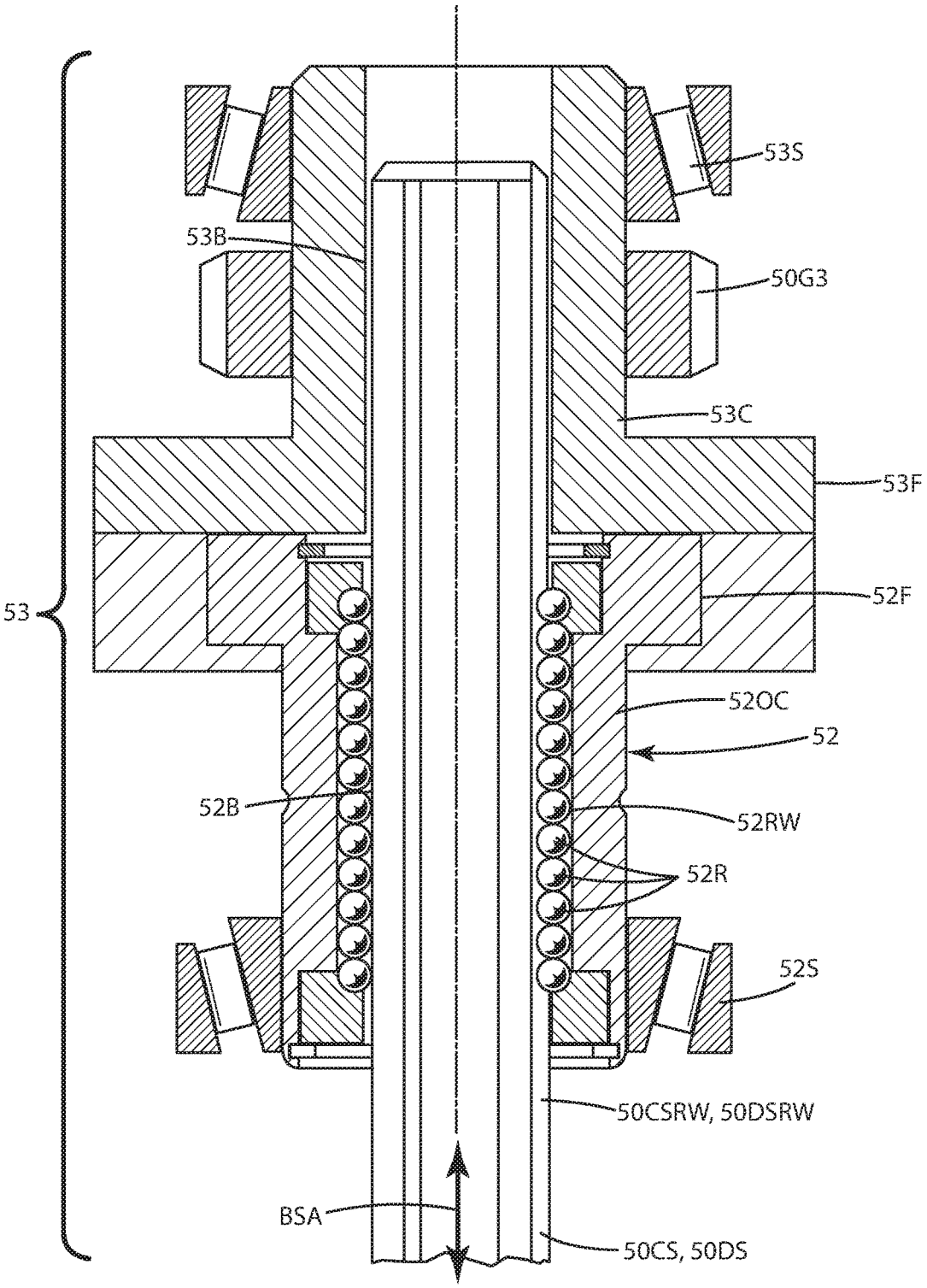
FIG. 7 is a section view of a ball spline having bearing elements interacting with a driveshaft so that the driveshaft can move linearly through the ball spline but can be non-rotatable relative to the ball spline, taken along line 7-7 of FIG. 5.

Referring to FIG. 7, the ball spline 52 can be any suitable type of ball spline. As illustrated, the ball spline 52 includes the outer cylinder 520C defining an internal bore 52B. This internal bore 52B can be coextensive with the internal bore 53B of the gear cylinder 53C so that a driveshaft SODS and/or connector shaft 50CS can move linearly through the ball spline 52. Generally, the connector shaft 50CS and/or the driveshaft SODS can move linearly through the ball spline and its internal bore along a ball spline axis BSA.

The ball spline 52 can define a first bearing raceway 52RW that is in communication with the internal bore, that is, objects within the first bearing raceway 52RW can move into and out from the internal bore 52B or portions thereof. The ball spline also includes multiple bearing elements 52R, which is illustrated are the forms of balls, such as ball bearings that are spherical in shape. These balls 52R are disposed in the first bearing raceway 52RW. The connector shaft 50CS and/or driveshaft SODS are likewise configured with a groove 50CSRW, 50DSRW. This groove effectively forms a second raceway. The second raceway is in communication with the first raceway 52RW. Accordingly the balls or bearings 52R can move and/or roll in the first raceway and in the second raceway, and/or can move from one raceway to another, depending on relative movement of the ball spline relative to the connector shaft 50CS and/or driveshaft SODS.

Via the interaction of the balls with the first raceway in outer cylinder 520C, as well as the second raceway defined by the connector shaft and/or driveshaft, the connector shaft and/or driveshaft can telescope or otherwise move linearly through the ball spline 52. In turn, the driveshaft and/or connector shaft are linearly movable relative to, and optionally through, the ball spline and its internal bore when the lower drive unit 30 is moved from the raised mode to the lowered mode and vice versa. Due to the ball spline's interaction with the shaft however, that shaft is rotationally fixed, that is, the shaft does not rotate relative to the ball spline. Accordingly, the ball spline 52 and the connector shaft and/or driveshaft rotate in unison, in both the raised mode and the lowered mode and all positions therebetween. Further, the ball spline, driveshaft and/or connector shaft also rotate in unison with the drive gear 50G3.

Figure 5:
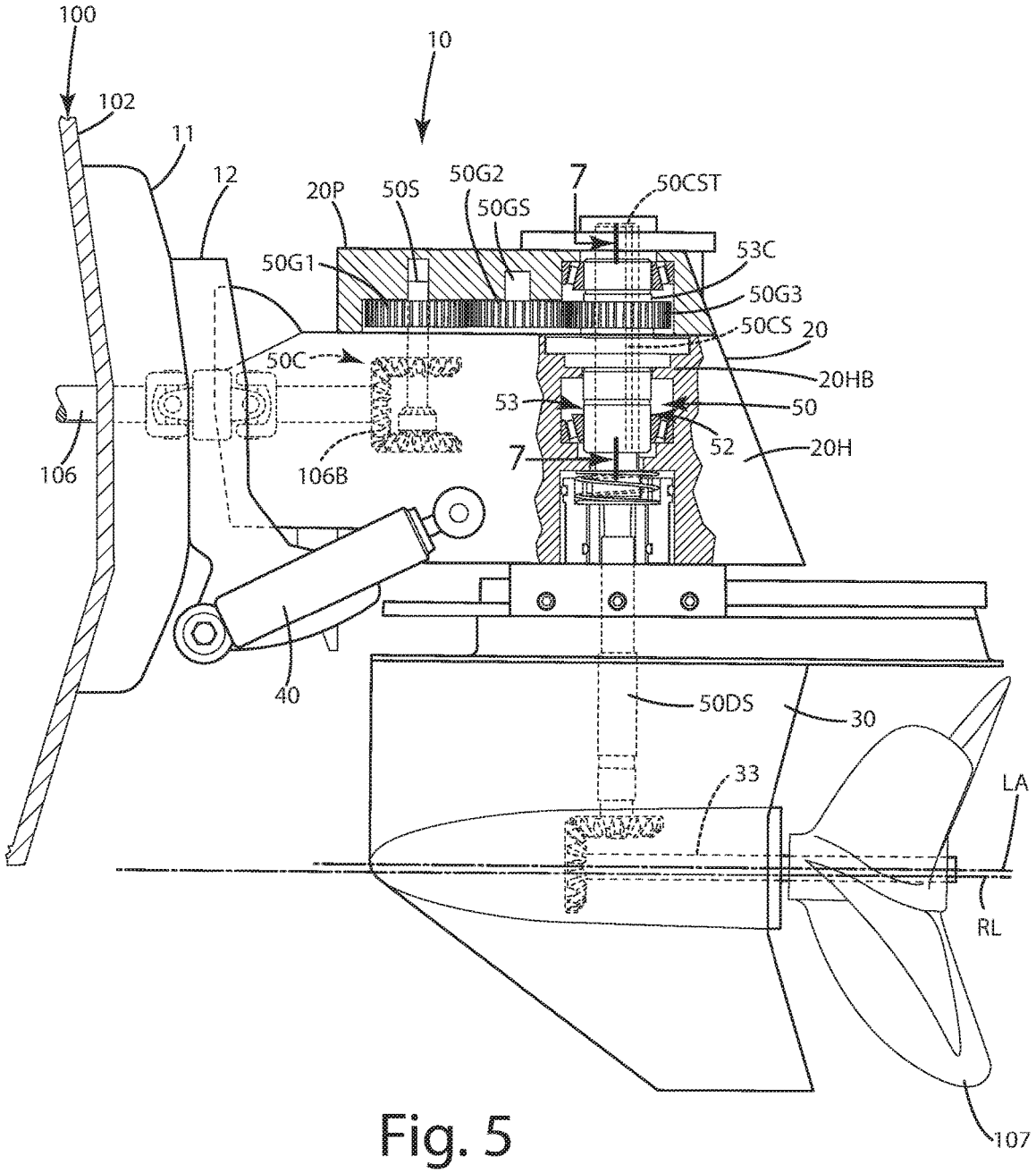
FIG. 5 is a side partial section view of a drive assembly of the outdrive with the lower drive unit in a raised mode.

Turning to FIGS. 5 and 9, as mentioned above, the drive assembly 50 can include a connector shaft 50CS and a driveshaft SODS. The connector shaft 50CS can be joined via a splined portion 50DSS of the driveshaft extending into and being received by a corresponding splined hole 50CSS of the connector shaft. The connector shaft and driveshaft can be further coupled to one another using a coupler bolt 50B that effectively joins two elements to one another. Of course, in some cases, the connector shaft can be eliminated from the construction. In this case, the driveshaft SODS is simply lengthened so that it can extend upwardly into the ball spline and upper housing more substantially. Optionally, as used herein, the term driveshaft can refer to a unitary driveshaft of a single construction, as well as a driveshaft combined with a connector shaft to form a longer, overall shaft. As mentioned above, the driveshaft extends downwardly into the lower drive unit 30 and is rotationally coupled to the propeller shaft 33 via one or more gears 34G and 33G. Upon rotation of the driveshaft, the propeller shaft 33 and propeller rotate as well.

Figure 6:
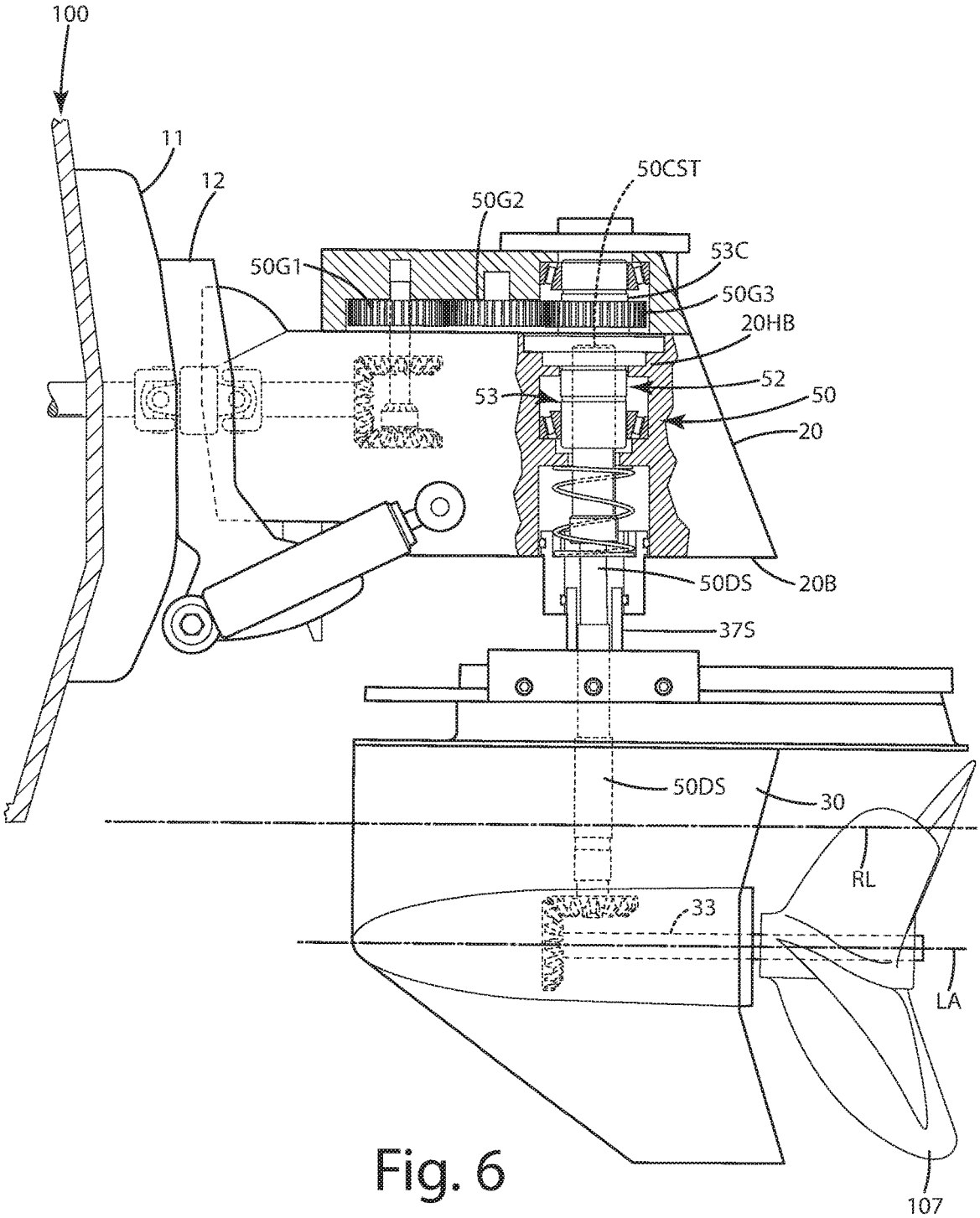
FIG. 6 is a side partial section view of the drive assembly of the outdrive with the lower drive unit in a lowered mode.

As shown in FIGS. 5 and 6, the drive assembly is structured to provide linear movement of the driveshaft SODS and connector shaft 50CS relative to the ball spline 52 while the drive assembly and outdrive are under power, and while the lower drive unit 30 is being moved from a raised mode shown in FIG. 5 to a lowered mode shown in FIG. 6. In addition, with the ball spline non-rotatably joined with the connector shaft and/or driveshaft, when the driveshaft gear 50G3 rotates, the ball spline rotates in unison with it and the driveshaft. Thus, with the ball spline, the driveshaft SODS and/or connector shaft 50CS can move through the ball spline gear unit 53 while still being rotatably coupled to the input shaft 106. In turn, the propeller shaft 33 effectively remains rotatably coupled to the input shaft through the driveshaft and ball spline and various other gears and shafts of the drive assembly 50.

In comparing the raised mode of the lower drive unit 30 in FIG. 5 to the lowered mode of the lower unit in FIG. 6, it can be seen that the driveshaft SODS and specifically the connector shaft 50CS extend farther beyond the bottom 20B of the upper unit 20 in the lowered mode. Further, the very top of the connector shaft 50CST moves from a position generally above the ball spline gear unit 53 in the raised mode, to a position generally below the driveshaft gear 50G3 in the lowered mode. The connector shaft top 50CST also can move toward and/or away from the bottom 20B of the upper unit 20. This movement of the drive and/or connector shafts (while they rotate) can be substantially linear, with little or no arcuate or pivoting movements of these elements relative to the upper unit, lower unit, or parts thereof. Of course the extent and relative movement of the top of that shaft can vary, depending on the desired spacing of the propeller shaft 33 and configuration of the gear assembly and its components. Optionally, the driveshaft and/or connector shaft can move linearly through and relative to the upper drive unit and/or lower drive unit as the outdrive converts from the raised mode to the lowered mode and vice versa. These shafts can, for example, slide vertically, linearly through one or more components of the upper drive unit.

Further optionally, the ball spline can be replaced with any type of spline connection between the connector shaft and the drive shaft so that the shafts can telescope linearly relative to one another. Accordingly, the drive shaft can extend and retract relative to the connector shaft, or vice versa, when the lower unit is raised and/or lowered.

An issue with the driveshaft and any related connector shaft extending from the upper drive unit 20, and generally from the bottom 20B of the upper drive unit 20 is that the driveshaft can be in communication with a supply of oil. Thus, when the lower drive unit 30 is moved from the raised mode shown in FIG. 5 to the lowered mode shown in FIG. 6, it can be helpful to shield and conceal the driveshaft and connector shaft, and any associated oil, from the elements, such as water, that would fill the space between the upper drive unit 20 and the lower drive unit 31 is lowered.

Figure 15:
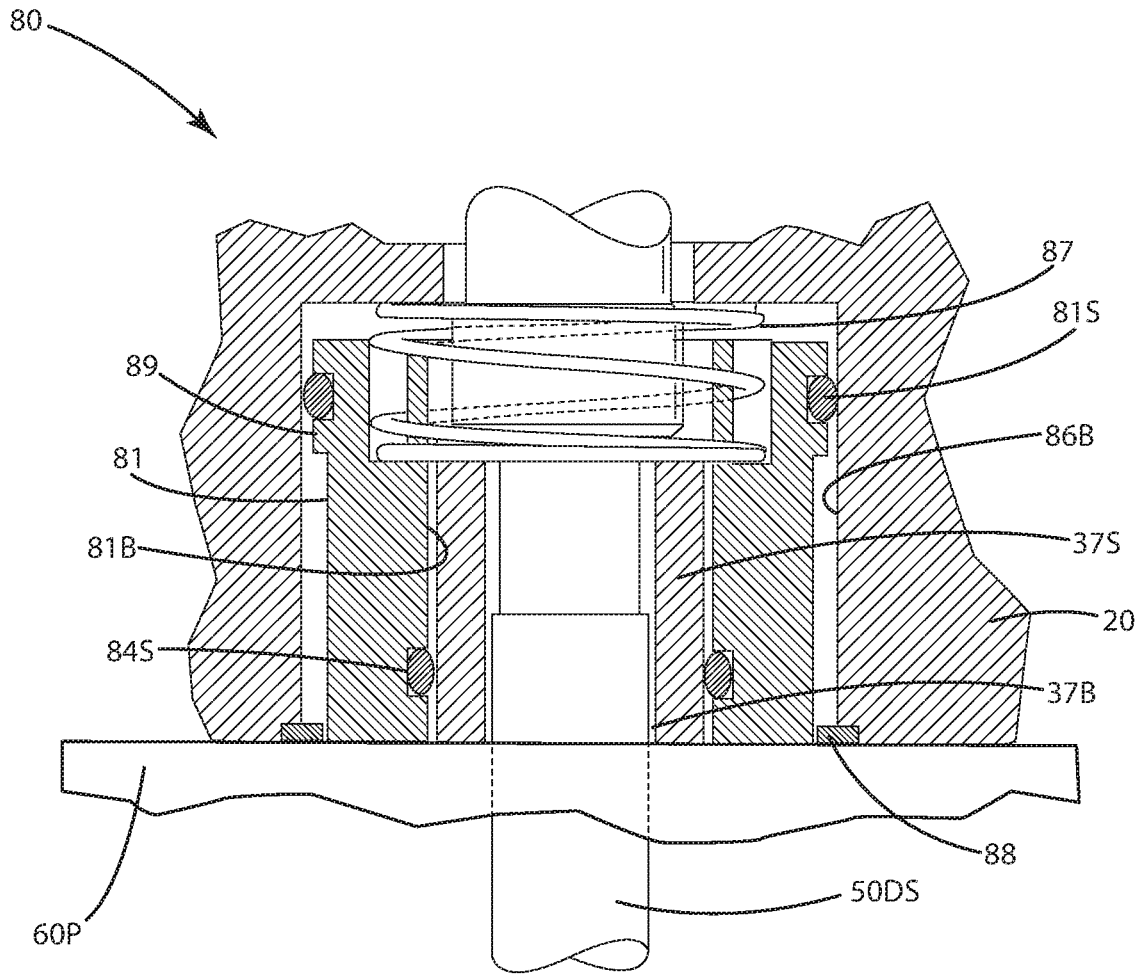
FIG. 15 is a partial section view of a shaft seal piston protecting the driveshaft with the lower drive unit in the raised mode.
Figure 16:
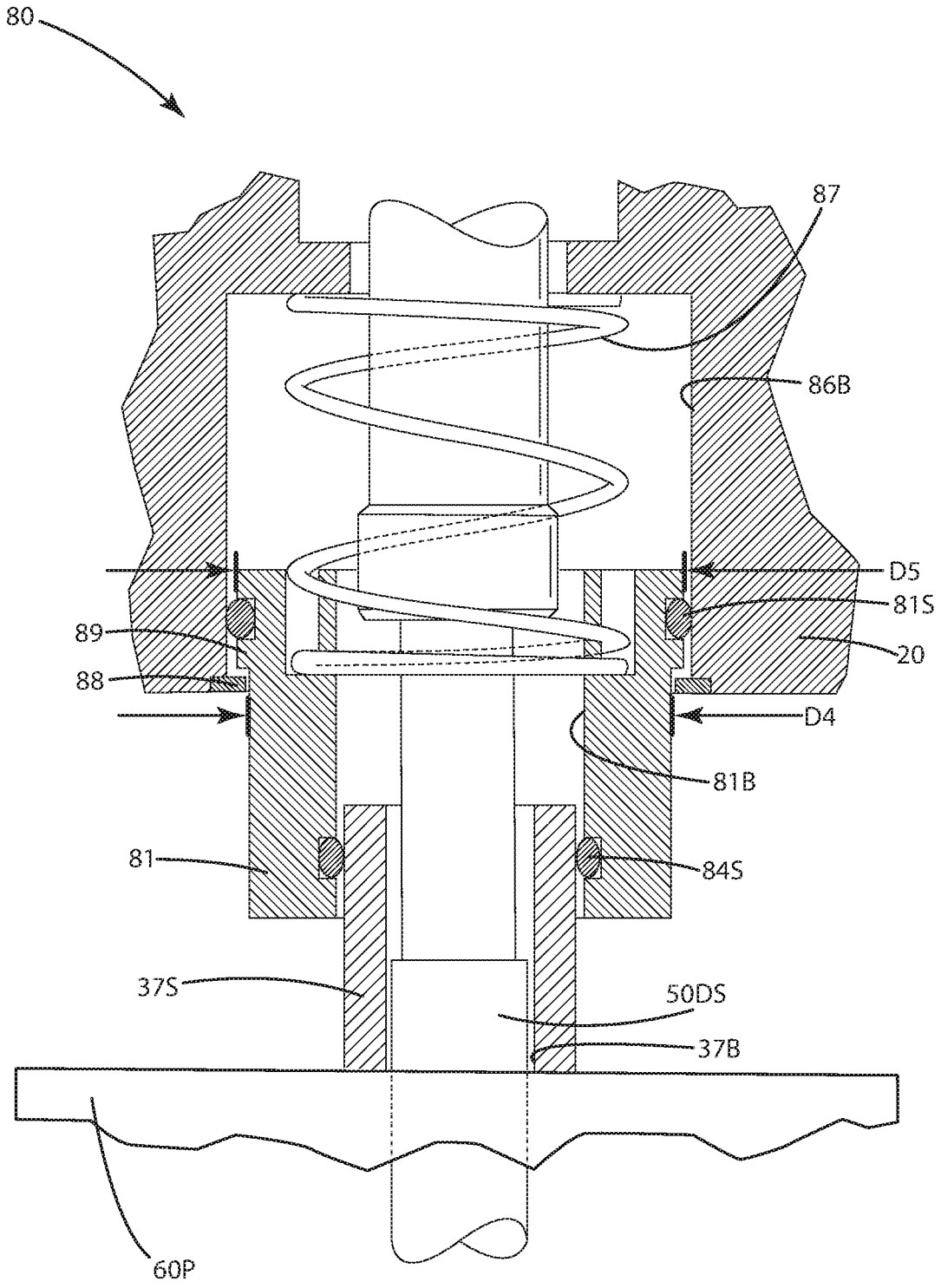
FIG. 16 is a partial section view of the shaft seal piston extending from the upper drive unit and continuing to protect the driveshaft with the lower drive unit in the lowered mode.

Accordingly, the outdrive 10 can be outfitted with a driveshaft seal assembly 80. As shown in FIGS. 15 and 16, this driveshaft seal assembly can effectively move with the driveshaft SODS from the raised mode of the lower drive unit 30 shown in FIGS. 5 and 15, to the lower mode of the lowered drive unit 30, shown in FIGS. 6 and 16. With this relative movement, the driveshaft seal assembly seals around and shields the driveshaft, even when it otherwise would be exposed to surrounding water when the lower drive unit is in the lowered mode.

The driveshaft seal assembly 80 can include a shaft seal piston 81. The shaft seal piston can include and define an internal shaft seal bore 81B. The driveshaft and/or connector shaft can be rotatably disposed within the shaft seal piston and in particular within the internal shaft seal bore 81B. The entire shaft seal piston also can be movably disposed in a telescoping manner within a shaft seal piston bore 86B defined by the upper drive unit 20. A seal, for example, an O-ring or other suitable gasket or seal 81S, can be disposed between an outer surface of the shaft seal piston 81 and the shaft seal piston bore 86B.

The shaft seal assembly 80 can include a stub 37S that extends upward from the lower drive unit 30 and in particular the plate 60P. This stub 37S can define an internal stub bore 37B. The driveshaft SODS and/or connector shaft 50CS can extend through and can rotate within that bore 37B. The stub 37S can be configured to fit within the internal shaft seal bore 81B. The internal shaft seal bore can further include another seal, such as another O-ring 84S that seals against the outer surface of the stub 37S.

The shaft seal assembly 80 can further include a biasing member 87, which can effectively push the shaft seal piston out from the shaft seal piston bore 86B when the lower drive unit 30 is moved from a raised mode to a lowered mode. FIG. 15 shows the shaft seal piston 81 disposed in the shaft seal piston bore 86B of the upper drive unit 20, when the lower drive unit 30 is in the raised mode. In this configuration the shaft seal piston seals the driveshaft SODS within the internal shaft seal bore 81B. The stub 37S projects into the internal shaft seal bore 81B as well. The seals 81S and 84S can prevent liquid from entering into the region where the driveshaft SODS is located.

When the lower unit 30 is moved to the lowered mode shown in FIG. 16, the shaft seal piston 81 is urged out from the shaft seal piston bore 86B via the biasing member 87. As illustrated this biasing member can be a coil spring. Of course other types of springs, gears or elastomeric elements can be used instead. The shaft seal piston 81 thus maintains the seal 81S between it and the shaft seal piston bore. Likewise, the stub seal 84S is maintained against the stub 37S. In the lowered mode, the stub begins to withdraw from the internal shaft seal bore 81B as shown in FIG. 16. Nonetheless, the seal 84S is maintained between the stub and the internal shaft seal bore. As a result, liquid is prevented from reaching the driveshaft SODS due to the driveshaft seal assembly 80.

Optionally, the shaft seal piston's movement can be delimited by a plate 88. The plate can be of a smaller diameter D4 than the diameter D5 of the shaft seal piston. Accordingly, a shoulder 89 of the shaft seal piston can engage the plate 88 and thereby stop movement of the shaft seal piston out from the shaft seal piston bore. Of course, in other applications, different systems can be used to limit movement of the shaft seal piston and otherwise seal the driveshaft and prevent water from leaking to it, or oil from leaking out of the outdrive 10.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An outdrive for a watercraft having an inboard engine, the outdrive comprising:

an input shaft extending through a transom of the watercraft, away from an engine within a hull of the watercraft, a mounting bracket configured to mount to the transom of a watercraft, an upper drive unit joined with the input shaft, the upper drive unit including a driveshaft rotatable upon rotation of the input shaft;

a lower drive unit joined with the upper drive unit, the lower drive unit including a housing, a propeller shaft rotatable upon rotation of the driveshaft, and a propeller joined with the propeller shaft and adapted to rotate therewith, thereby producing thrust to propel the watercraft through a body of water;

wherein the lower drive unit is operable in a raised mode, in which the lower drive unit is disposed adjacent the upper drive unit, and in a lowered mode, in which the lower drive unit is disposed a preselected distance away from the upper drive unit, wherein the lower drive unit is moveable from the raised mode to the lowered mode while the watercraft is moving through a body of water and while the propeller is producing thrust, wherein the upper drive unit is supported by the mounting bracket, wherein the upper drive unit is pivotally mounted relative to the mounting bracket so that the upper drive unit and the lower drive unit can tilt up and down together, but the upper drive unit and the lower drive unit do not tilt relative to one another.

2. An outdrive for a watercraft having an inboard engine, the outdrive comprising:

an input shaft extending through a transom of the watercraft, away from an engine within a hull of the watercraft, an upper drive unit joined with the input shaft, the upper drive unit including a driveshaft rotatable upon rotation of the input shaft;

a gimbal ring;

an actuator extending from the gimbal ring to the upper drive unit, a lower drive unit joined with the upper drive unit, the lower drive unit including a housing, a propeller shaft rotatable upon rotation of the driveshaft, and a propeller joined with the propeller shaft and adapted to rotate therewith, thereby producing thrust to propel the watercraft through a body of water;

wherein the lower drive unit is operable in a raised mode, in which the lower drive unit is disposed adjacent the upper drive unit, and in a lowered mode, in which the lower drive unit is disposed a preselected distance away from the upper drive unit, wherein the lower drive unit is moveable from the raised mode to the lowered mode while the watercraft is moving through a body of water and while the propeller is producing thrust, wherein the actuator is configured to move the upper drive unit from a first tilted mode in which the propeller shaft is in a first angle, relative to a reference line projecting rearward from a bottom of the transom of the watercraft, to a second tilted mode in which the propeller shaft is in a second different angle relative to the reference line projecting rearward from the bottom of the transom of the watercraft.

3. An outdrive for a watercraft having an inboard engine, the outdrive comprising:

an input shaft extending through a transom of the watercraft, away from an engine within a hull of the watercraft, an upper drive unit joined with the input shaft, the upper drive unit including a driveshaft rotatable upon rotation of the input shaft;

a lower drive unit joined with the upper drive unit, the lower drive unit including a housing, a propeller shaft rotatable upon rotation of the driveshaft, and a propeller joined with the propeller shaft and adapted to rotate therewith, thereby producing thrust to propel the watercraft through a body of water;

a ball spline including an outer cylinder defining an internal bore, a first bearing raceway in communication with the internal bore, and a plurality of bearing elements disposed in the first bearing raceway, wherein the lower drive unit is operable in a raised mode, in which the lower drive unit is disposed adjacent the upper drive unit, and in a lowered mode, in which the lower drive unit is disposed a preselected distance away from the upper drive unit, wherein the lower drive unit is moveable from the raised mode to the lowered mode while the watercraft is moving through a body of water and while the propeller is producing thrust, wherein at least one of the driveshaft and a connector shaft is disposed within the internal bore of the ball spline, wherein the at least one of the driveshaft and the connector shaft are linearly movable relative to the ball spline when the lower drive unit is moved from the raised mode to the lowered mode, but wherein the at least one of the driveshaft and the connector shaft is rotationally fixed relative to the ball spline so that the ball spline and the at least one of the driveshaft and the connector shaft rotate in unison in both the raised mode and the lowered mode.

4. The outdrive of claim 3, wherein the connector shaft is fixedly joined with the driveshaft, wherein the driveshaft is rotatably coupled with the propeller shaft, wherein the connector shaft is disposed in the internal bore, wherein the connector shaft includes a second raceway in communication with the first raceway so that the plurality of bearings move from the first raceway to the second raceway when the lower drive unit is moved from the raised mode to the lowered mode.

5. An outdrive for a watercraft having an inboard engine, the outdrive comprising:

an input shaft extending through a transom of the watercraft, away from an engine within a hull of the watercraft, an upper drive unit joined with the input shaft, the upper drive unit including a driveshaft rotatable upon rotation of the input shaft;

a lower drive unit joined with the upper drive unit, the lower drive unit including a housing, a propeller shaft rotatable upon rotation of the driveshaft, and a propeller joined with the propeller shaft and adapted to rotate therewith, thereby producing thrust to propel the watercraft through a body of water;

a shaft seal piston defining an internal shaft seal bore, wherein the lower drive unit is operable in a raised mode, in which the lower drive unit is disposed adjacent the upper drive unit, and in a lowered mode, in which the lower drive unit is disposed a preselected distance away from the upper drive unit, wherein the lower drive unit is moveable from the raised mode to the lowered mode while the watercraft is moving through a body of water and while the propeller is producing thrust, wherein the driveshaft extends within the internal shaft seal bore, wherein the shaft seal piston is movably joined with the upper drive unit, wherein the shaft seal piston shields the driveshaft from water within which the outdrive is operated.

6. The outdrive of claim 5, wherein the shaft seal piston is disposed in a shaft seal piston bore of the upper drive unit, wherein a biasing element engages the shaft seal piston to move the shaft seal piston relative to the shaft seal piston bore when the lower unit is moved from the raised mode to the lowered mode so that the driveshaft remains concealed within the shaft seal piston in the lowered mode.

7. An outdrive for a watercraft having an inboard engine, the outdrive comprising:

an input shaft extending through a transom of the watercraft, away from an engine within a hull of the watercraft, an upper drive unit joined with the input shaft, the upper drive unit including a driveshaft rotatable upon rotation of the input shaft;

a lower drive unit joined with the upper drive unit, the lower drive unit including a housing, a propeller shaft rotatable upon rotation of the driveshaft, and a propeller joined with the propeller shaft and adapted to rotate therewith, thereby producing thrust to propel the watercraft through a body of water;

a clutch shaft configured to be rotatably engaged by the input shaft;

a clutch shaft gear fixedly and non-rotatably mounted to the clutch shaft;

an idler gear rotatably engaged by the clutch shaft gear;

a driveshaft gear joined with the upper drive unit rotatably engaged by the idler gear;

a ball spline fixedly and non-rotatably mounted to the driveshaft gear, the ball spline being rotatably mounted in the upper drive unit;

wherein the lower drive unit is operable in a raised mode, in which the lower drive unit is disposed adjacent the upper drive unit, and in a lowered mode, in which the lower drive unit is disposed a preselected distance away from the upper drive unit, wherein the lower drive unit is moveable from the raised mode to the lowered mode while the watercraft is moving through a body of water and while the propeller is producing thrust, wherein at least one of the driveshaft and a connector shaft extend through the ball spline, wherein the at least one of the driveshaft and a connector shaft are linearly movable through the ball spline, but are rotationally fixed relative to the ball spline so that when the driveshaft gear rotates, the ball spline rotates the driveshaft and subsequently the propeller shaft.

8. An outdrive upper drive unit for a watercraft having an inboard engine, the outdrive upper drive unit comprising:

an upper drive unit housing defining a ball spline receiver bore and an upper drive unit bottom;

a ball spline rotatably disposed in the ball spline receiver bore, the ball spline joined with a driveshaft gear;

at least one of a driveshaft and a connector shaft joined with the ball spline, wherein the at least one of a driveshaft and a connector shaft is linearly movable through the ball spline, but rotationally fixed relative to the ball spline so that when the driveshaft gear rotates, the ball spline rotates in unison with the driveshaft gear and the at least one of a driveshaft and a connector shaft, wherein the at least one of a driveshaft and a connector shaft moves relative to the upper drive unit bottom when the at least one of a driveshaft and a connector shaft linearly move through the ball spline.

9. The outdrive upper drive unit of claim 8, wherein the ball spline includes an outer cylinder defining an internal bore, a first bearing raceway in communication with the internal bore, and a plurality of bearing elements disposed in the first bearing raceway, wherein the at least one of the driveshaft and a connector shaft is disposed within the internal bore of the ball spline, wherein the at least one of the driveshaft and a connector shaft includes a second raceway in communication with the first raceway so that the plurality of bearings can move in the first raceway and in the second raceway upon movement of the at least one of the driveshaft and a connector shaft relative to the upper drive unit bottom.

10. The outdrive upper drive unit of claim 8 comprising:

a clutch shaft rotatably mounted in the upper drive unit housing, the clutch shaft configured to be rotatably engaged by an input shaft of the watercraft;

a clutch shaft gear non-rotatably mounted to the clutch shaft;

an idler gear joined with the upper drive unit and rotatably engaged by the clutch shaft gear;

wherein the driveshaft gear is rotatably engaged by the idler gear.

11. The outdrive upper drive unit of claim 8 comprising:

a guide shaft bore defined by the upper drive unit housing;

an elongated guide shaft movably disposed within the guide shaft bore, wherein the guide shaft is configured to telescope relative to the guide shaft bore upon movement of the at least one of the driveshaft and a connector shaft relative to the upper drive unit bottom.

12. The outdrive upper drive unit of claim 8 comprising:

a shaft seal piston defining an internal shaft seal bore; and a biasing element adjacent the shaft seal piston, wherein the at least one of the driveshaft and the connector shaft extends within the internal shaft seal bore, wherein the shaft seal piston is disposed in a shaft seal piston bore defined by the upper drive unit housing, wherein a biasing element engages the shaft seal piston to move the shaft seal piston relative to the shaft seal piston bore upon movement of the at least one of the driveshaft and a connector shaft relative to the upper drive unit bottom.

13. A method of operating an outdrive for a watercraft, the method comprising:

rotating an input shaft extending from a transom of a watercraft;

rotating a driveshaft coupled to the input shaft, the driveshaft disposed in an upper drive unit;

rotating a propeller shaft coupled to the driveshaft, the propeller shaft joined with a propeller, the propeller shaft rotatably disposed in a lower drive unit;

moving the lower drive unit away from the upper drive unit a preselected distance while rotating the driveshaft and propeller shaft, the moving occurring while the propeller spins and the watercraft is moving through a body of water, rotating a clutch shaft and a clutch shaft gear with the input shaft;

rotating a driveshaft gear with at least one of the clutch shaft gear and an idler gear, thereby rotating a ball spline; and moving at least one of the driveshaft and a connector shaft through an internal bore defined by the ball spline while moving the lower drive unit away from the upper drive unit the preselected distance.

14. A method of operating an outdrive for a watercraft, the method comprising:

rotating an input shaft extending from a transom of a watercraft;

rotating a driveshaft coupled to the input shaft, the driveshaft disposed in an upper drive unit;

rotating a propeller shaft coupled to the driveshaft, the propeller shaft joined with a propeller, the propeller shaft rotatably disposed in a lower drive unit;

moving the lower drive unit away from the upper drive unit a preselected distance while rotating the driveshaft and propeller shaft, the moving occurring while the propeller spins and the watercraft is moving through a body of water; and moving at least one of the driveshaft and a connector shaft through an internal bore defined by a ball spline while moving, in only a linear, non-rotating manner, but with the at least one of the driveshaft and a connector shaft rotating the lower drive unit away from the upper drive unit the preselected distance.

15. A watercraft comprising:

a hull including a bow and a stern, with a transom located at the stern;

a reference line projecting rearward from a lowermost portion of the transom;

an engine disposed in the hull;

an input shaft extending away from the engine and outwardly from the transom;

an upper drive unit joined with and selectively tiltable relative to the transom;

a driveshaft joined with the upper drive unit and rotatably coupled to the input shaft; and a lower drive unit joined with the upper drive unit, the lower drive unit including a propeller shaft and a propeller, the propeller shaft rotatably coupled to the driveshaft;

wherein the lower drive unit is moveable toward and away from the upper drive unit in a substantially linear manner while the watercraft is moving through a body of water and while the propeller is rotating so as to move the propeller shaft relative to the reference line while maintaining the propeller shaft in a fixed angular relationship relative to the reference line, whereby movement of the lower drive unit away from the upper drive unit lowers a thrust point of the watercraft so as to lift a bow of the watercraft as the watercraft is moving through the body of water.

* * * * *